US009458845B2

(12) United States Patent
White et al.

(10) Patent No.: US 9,458,845 B2
(45) Date of Patent: Oct. 4, 2016

(54) AIR DUCTING SHROUD FOR COOLING AN AIR COMPRESSOR PUMP AND MOTOR

(75) Inventors: Gary D. White, Medina, TN (US); Scott D. Craig, Jackson, TN (US); Christina Wilson, Jackson, TN (US)

(73) Assignee: Black & Decker Inc., New Britain, CT (US)

( * ) Notice: Subject to any disclaimer, the term of this patent is extended or adjusted under 35 U.S.C. 154(b) by 379 days.

(21) Appl. No.: 13/609,331

(22) Filed: Sep. 11, 2012

(65) Prior Publication Data

US 2013/0064641 A1 Mar. 14, 2013

Related U.S. Application Data

(60) Provisional application No. 61/533,993, filed on Sep. 13, 2011, provisional application No. 61/534,001, filed on Sep. 13, 2011, provisional application No. 61/534,009, filed on Sep. 13, 2011, provisional application No. 61/534,015, filed on Sep. 13, 2011, provisional application No. 61/534,046, filed on Sep. 13, 2011.

(51) Int. Cl.

| | |
|---|---|
| ***F04B 39/00*** | (2006.01) |
| ***F04B 39/06*** | (2006.01) |
| ***F04D 19/00*** | (2006.01) |
| ***F04D 29/66*** | (2006.01) |
| ***F04B 23/10*** | (2006.01) |

(Continued)

(52) U.S. Cl.

CPC ..... *F04B 39/0033* (2013.01); *F04B 23/10* (2013.01); *F04B 35/06* (2013.01); *F04B 39/0027* (2013.01); *F04B 39/0055* (2013.01); *F04B 39/0061* (2013.01); *F04B 39/066* (2013.01); *F04B 39/121* (2013.01); *F04B 41/02* (2013.01); *F04D 19/00* (2013.01); *F04D 29/668* (2013.01); *Y10S 181/403* (2013.01); *Y10T 29/49238* (2015.01); *Y10T 137/7039* (2015.04)

(58) Field of Classification Search

CPC ... F04F 1/12; F04B 39/0055; F04B 39/0027; F04B 39/0033; F04B 39/0061; F04B 39/066; F04B 39/121; F04B 23/10; F04B 35/06; F04B 41/02; H02K 9/06; F04D 19/00; F04D 29/668; Y10T 137/7039; Y10T 29/49238; Y10S 181/403

USPC ..... 417/119.1, 312, 415; 310/62, 63

See application file for complete search history.

(56) References Cited

U.S. PATENT DOCUMENTS

| | | | |
|---|---|---|---|
| 1,694,218 | A | 6/1924 | Hazard |
| 1,924,654 | A | 3/1930 | Petersen |

(Continued)

FOREIGN PATENT DOCUMENTS

| | | | |
|---|---|---|---|
| DE | 10117791 | A1 | 10/2002 |
| JP | 54041562 | A | 4/1979 |
| JP | 1080793 | A | 3/1989 |
| JP | 4232390 | A | 8/1992 |
| JP | 5133330 | A | 5/1993 |
| JP | 7109977 | A | 4/1995 |
| JP | 9250456 | A | 9/1997 |
| JP | 9250457 | A | 9/1997 |
| JP | 10148135 | A | 6/1998 |
| JP | 10339268 | A | 12/1998 |
| JP | 2006292243 | A | 10/2006 |

*Primary Examiner* — William H Rodriguez
*Assistant Examiner* — Christopher Brunjes
(74) *Attorney, Agent, or Firm* — Rhonda L. Barton

(57) ABSTRACT

A compressor assembly having an air ducting shroud that can direct a cooling air stream from a fan to components of the compressor assembly, such as a pump assembly. The pump assembly can have at least a pump, a motor and a fan. The compressor can be cooled by providing cooling air to a cylinder head of the pump without the cooling air experiencing choking or substantial cooling flow interference from a cooling of the motor.

17 Claims, 34 Drawing Sheets

(51) Int. Cl.

| | |
|---|---|
| ***F04B 35/06*** | (2006.01) |
| ***F04B 41/02*** | (2006.01) |
| ***F04B 39/12*** | (2006.01) |

(56) References Cited

U.S. PATENT DOCUMENTS 2,059,894 A 6/1933 Newman
2,136,098 A 7/1937 Browne
2,312,596 A 2/1940 Smith
2,343,952 A 2/1943 Branstrom
2,375,442 A 5/1945 Sandberg
D181,459 S 11/1957 Bullock
3,525,606 A 8/1970 Bodine
3,537,544 A 11/1970 King et al.
3,710,094 A 1/1973 Monte et al.
3,930,558 A 1/1976 Schnell et al.
3,955,900 A 5/1976 Vinci
3,978,919 A 9/1976 Fachbach et al.
3,980,912 A 9/1976 Panza
4,190,402 A 2/1980 Meece et al.
4,264,282 A * 4/1981 Crago ..... F04C 29/066 181/202
4,289,630 A 9/1981 Schmidt, Jr. et al.
4,302,224 A 11/1981 McCombs et al.
D263,216 S 3/1982 Maher
4,342,573 A 8/1982 McCombs et al.
4,401,418 A 8/1983 Fritchman
4,460,319 A 7/1984 Ashikian
4,553,903 A 11/1985 Ashikian
4,566,800 A 1/1986 Bodine
4,722,673 A 2/1988 Grime et al.
4,907,546 A 3/1990 Ishii et al.
4,928,480 A 5/1990 Oliver et al.
4,950,133 A 8/1990 Sargent
4,988,268 A 1/1991 Kurihara
5,020,973 A 6/1991 Lammers
5,133,475 A 7/1992 Sharp
5,137,434 A 8/1992 Wheeler et al.
D335,407 S 5/1993 Ngian et al.
5,213,484 A 5/1993 Hashimoto et al.
5,311,090 A 5/1994 Ferlatte
5,311,625 A 5/1994 Barker et al.
5,336,046 A 8/1994 Hashimoto et al.
5,407,330 A 4/1995 Rimington et al.
5,417,258 A 5/1995 Privas
5,526,228 A 6/1996 Dickson et al.
5,620,370 A 4/1997 Umai et al.
5,678,543 A 10/1997 Bower
5,725,361 A 3/1998 Dantlgraber
6,023,938 A 2/2000 Taras et al.
6,091,160 A 7/2000 Kouchi et al.
6,099,268 A 8/2000 Pressel
6,100,599 A * 8/2000 Kouchi ..... F02B 63/04 290/1 A
6,145,974 A 11/2000 Shinada et al.
D437,581 S 2/2001 Aruga et al.
D437,825 S 2/2001 Imai
6,206,654 B1 3/2001 Cassidy
D444,796 S 7/2001 Morgan
D444,797 S 7/2001 Davis et al.
6,257,842 B1 7/2001 Kawasaki et al.
6,331,740 B1 12/2001 Morohoshi et al.
D454,357 S 3/2002 Diels
6,357,338 B2 3/2002 Montgomery
6,362,533 B1 3/2002 Morohoshi et al.
6,378,468 B1 4/2002 Kouchi et al.
6,378,469 B1 4/2002 Hiranuma et al.
6,386,833 B1 5/2002 Montgomery
D461,196 S 8/2002 Buck
6,428,283 B1 8/2002 Bonior
6,428,288 B1 8/2002 King
6,431,839 B2 8/2002 Gruber et al.
6,435,076 B2 8/2002 Montgomery
6,447,257 B2 9/2002 Orschell
6,454,527 B2 9/2002 Nishiyama et al.
6,474,954 B1 11/2002 Bell et al.
6,554,583 B1 * 4/2003 Pressel ..... F04B 27/1072 417/271
6,682,317 B2 1/2004 Chen
6,751,941 B2 6/2004 Edelman et al.
6,784,560 B2 8/2004 Sugimoto et al.
6,790,012 B2 9/2004 Sharp et al.
6,814,659 B2 11/2004 Cigelske, Jr.
D499,431 S 12/2004 Chen
6,952,056 B2 10/2005 Brandenburg et al.
6,962,057 B2 11/2005 Kurokawa et al.
6,991,436 B2 * 1/2006 Beckman et al. ..... 417/201
6,998,725 B2 2/2006 Brandenburg et al.
D517,009 S 3/2006 Xiao
D521,929 S 5/2006 Xiao
D531,193 S 10/2006 Caito
7,147,444 B2 12/2006 Cheon
D536,348 S 2/2007 Bass
D536,708 S 2/2007 Bass
7,189,068 B2 3/2007 Thomas, Jr. et al.
D551,141 S 9/2007 Canitano
7,283,359 B2 10/2007 Bartell et al.
D566,042 S 4/2008 Yamasaki et al.
D568,797 S 5/2008 Elwell
D572,658 S 7/2008 Yamamoto et al.
7,392,770 B2 7/2008 Xiao
7,398,747 B2 7/2008 Onodera et al.
7,398,855 B2 7/2008 Seel
7,400,501 B2 7/2008 Bartell et al.
D576,723 S 9/2008 Achen
7,430,992 B2 10/2008 Murakami et al.
7,452,256 B2 11/2008 Kasai et al.
7,491,264 B2 2/2009 Tao et al.
D588,987 S 3/2009 Kato
D589,985 S 4/2009 Steinfels
D593,032 S 5/2009 Wang et al.
7,541,701 B2 * 6/2009 Lin ..... H02K 11/33 310/58
7,563,077 B2 7/2009 Santa Ana
D600,205 S 9/2009 Imai
7,597,340 B2 10/2009 Hirose et al.
7,614,473 B2 11/2009 Ono et al.
7,643,284 B2 1/2010 Nakamura
7,678,165 B2 3/2010 Tingle et al.
7,707,711 B2 5/2010 Bartell et al.
7,743,739 B2 6/2010 Kochi et al.
7,779,792 B2 8/2010 Kubo et al.
7,779,793 B2 8/2010 Ito et al.
7,854,517 B2 12/2010 Tsubura
2004/0018098 A1 * 1/2004 Beckman ..... F04B 39/066 417/234
2005/0092544 A1 5/2005 Lee
2005/0220640 A1 10/2005 Finkenbinder et al.
2006/0104830 A1 5/2006 Fields
2006/0104833 A1 5/2006 Hueppchen
2006/0104834 A1 5/2006 Stilwell
2006/0104837 A1 5/2006 Lee et al.
2008/0045368 A1 2/2008 Nishihara
2008/0053746 A1 3/2008 Albert et al.
2008/0152518 A1 6/2008 Stilwell
2008/0181794 A1 * 7/2008 Steinfels ..... F04B 35/04 417/234
2008/0187447 A1 * 8/2008 Steinfels ..... F04B 35/06 417/234
2009/0010771 A1 * 1/2009 Vinson ..... F04D 25/082 417/366
2009/0016902 A1 1/2009 Lee et al.
2009/0194177 A1 * 8/2009 Yokota ..... F04B 35/04 137/565.18
2010/0001598 A1 * 1/2010 Staigl, III ..... H02K 11/33 310/71
2010/0101248 A1 * 4/2010 Lifson ..... F25B 49/02 62/115
2010/0112929 A1 5/2010 Iantorno
2010/0225012 A1 9/2010 Fitton et al.
2010/0226750 A1 9/2010 Gammack

(56) References Cited

U.S. PATENT DOCUMENTS

| | | | | |
|---|---|---|---|---|
| 2010/0226771 | A1 | 9/2010 | Crawford et al. | |
| 2010/0226787 | A1 | 9/2010 | Gammack et al. | |
| 2010/0317281 | A1 | 12/2010 | Sperandio et al. | |
| 2011/0094052 | A1 | 4/2011 | Witter | |
| 2011/0095540 | A1 | 4/2011 | Jackson et al. | |
| 2011/0158828 | A1* | 6/2011 | Nutz | F04B 35/06 417/234 |
| 2011/0182754 | A1 | 7/2011 | Gathers et al. | |

* cited by examiner

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 65 – 75 | 2.4 - 3.5 | | | | | | | | | | |
| 65 – 75 | | 150 - 250 | | | | | | | | | |
| 65 – 75 | | | 60 - 200 | | | | | | | | |
| 65 – 75 | | | | 50 - 100 | | | | | | | |
| 65 – 75 | 2.4 - 3.5 | 150 - 250 | 60 - 200 | | | | | | | | |
| 65 – 75 | 2.4 - 3.5 | 150 - 250 | | 50 - 100 | | | | | | | |
| 65 – 75 | 2.4 - 3.5 | 150 - 250 | | | 1500 - 3000 | 1.5 - 2.25 | 1.3 - 2 | | | | |
| 65 – 75 | 2.4 - 3.5 | 150 - 250 | | | | | | 2.3 - 8 | 33 - 50 | | |
| 65 – 75 | 2.4 - 3.5 | 150 - 250 | | | | | | | | 1000-1800 | 45 - 65 |

FIG. 17

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 65 – 75 | | | | | 1500 - 3000 | | | | | | |
| 65 – 75 | | | | | | 1.5 - 2.25 | | | | | |
| 65 – 75 | | | | | | | 1.3 - 2 | | | | |
| 65 – 75 | | | | | | | | 2.3 - 8 | | | |
| 65 – 75 | | | | | | | | | 33 - 50 | | |
| 65 – 75 | | | | | | | | | | 1000-1800 | |
| 65 – 75 | 2.4 - 3.5 | 150 - 250 | 60 - 200 | 50 - 100 | | | | | | | 45 - 65 |
| 65 – 75 | | | | | 1500 - 3000 | 1.5 - 2.25 | | | | | |
| 65 – 75 | 2.4 - 3.5 | 150 - 250 | 60 - 200 | 50 - 100 | 1500 - 3000 | 1.5 - 2.25 | 1.3 - 2 | | | | |
| 65 – 75 | 2.4 - 3.5 | 150 - 250 | 60 - 200 | 50 - 100 | 1500 - 3000 | 1.5 - 2.25 | 1.3 - 2 | 2.3 - 8 | 33 - 50 | 1000-1800 | 45 - 65 |

FIG. 18

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 70.5 | 2.9 | | | 71.5 | | | | | | | |
| 70.5 | 2.9 | | | | 2300 | 1.875 | 1.592 | | | | |
| 70.5 | 2.9 | | | | | | | 4.4 | 41 | | |
| 70.5 | 2.9 | | | | | | | | | 1446 | 56.5 |
| 70.5 | 2.9 | 200 | 84.1 | | | | | | | | |
| 70.5 | 2.9 | 200 | | 71.5 | | | | | | | |
| 70.5 | 2.9 | 200 | | | 2300 | 1.875 | 1.592 | | | | |
| 70.5 | 2.9 | 200 | | | | | | 4.4 | 41 | | |
| 70.5 | 2.9 | 200 | | | | | | | | 1446 | 56.5 |
| 70.5 | 2.9 | | 84.1 | | | | | | | | |
| 70.5 | 2.9 | | | 71.5 | | | | | | | |
| 70.5 | 2.9 | | | | 2300 | | | | | | |
| 70.5 | 2.9 | | | | | | | | | 1446 | |
| 70.5 | | 200 | 84.1 | | | | | | | | |
| 70.5 | | 200 | | 71.5 | | | | | | | |
| 70.5 | | 200 | | | 2300 | | | | | | |
| 70.5 | | 200 | | | | | | | | 1446 | |
| 70.5 | | | 84.1 | 71.5 | | | | | | | |
| 70.5 | | | 84.1 | | 2300 | | | | | | |
| 70.5 | | | | | | | | | | 1446 | |

FIG. 19

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 70.5 | 2.9 | 200 | 84.1 | 71.5 | | | | | | | |
| 70.5 | 2.9 | 200 | 84.1 | | 2300 | | | | | | |
| 70.5 | 2.9 | 200 | 84.1 | 71.5 | 2300 | | | | | | |
| 70.5 | 2.9 | 200 | 84.1 | | | 1.875 | | | | | |
| 70.5 | 2.9 | 200 | 84.1 | | | | 1.592 | | | | |
| 70.5 | 2.9 | 200 | 84.1 | 71.5 | 2300 | | | | | | |
| 70.5 | 2.9 | 200 | 84.1 | 71.5 | 2300 | 1.875 | | | | | |
| 70.5 | 2.9 | 200 | 84.1 | 71.5 | 2300 | | 1.592 | | | | |
| 70.5 | 2.9 | 200 | 84.1 | 71.5 | 2300 | 1.875 | 1.592 | | | | |
| 70.5 | 2.9 | 200 | 84.1 | | | | | 4.4 | | | |
| 70.5 | 2.9 | 200 | 84.1 | | | | | | 41 | | |
| 70.5 | 2.9 | 200 | 84.1 | 71.5 | 2300 | 1.875 | 1.592 | 4.4 | | | |
| 70.5 | 2.9 | 200 | 84.1 | 71.5 | 2300 | 1.875 | 1.592 | 4.4 | 41 | | |
| 70.5 | 2.9 | 200 | 84.1 | | | | | | | 1446 | |
| 70.5 | 2.9 | 200 | 84.1 | | | | | | | | 56.5 |
| 70.5 | 2.9 | 200 | 84.1 | 71.5 | 2300 | 1.875 | 1.592 | 4.4 | 41 | 1446 | |
| 70.5 | 2.9 | 200 | 84.1 | 71.5 | 2300 | 1.875 | 1.592 | 4.4 | 41 | 1446 | 56.5 |

FIG. 20

| | Compressor Assembly Performance Data |
|---|---|
| Motor Speed (RPM) | 11200 |
| Pump Speed (RPM) | 2300 |
| Voltage | 120 |
| Air Flow (SCFM) @ 90 psi | 2.9 |
| Current Draw @ 90 psi (amps) | 11.8 |
| Volumetric Efficiency @ 90 psi | 49.6% |
| Motor Torque (lb-in) @ 90 psi | 6.01 |
| Motor Efficiency @ 90 psi | 56.3% |
| Air Flow (SCFM) @ 150 psi | 2.4 |
| Current Draw @ 150 psi (amps) | 12.05 |
| Volumetric Efficiency @ 150 psi | 41.0% |
| Motor Torque (lb-in) @ 150 psi | 6.16 |
| Motor Efficiency @ 150 psi | 56.5% |
| Air Flow (SCFM) @ 200 psi | 2.15 |
| Current Draw @ 200 psi (amps) | 11.88 |
| Volumetric Efficiency @ 200 psi | 36.7% |
| Motor Torque (lb-in) @ 200 psi | 6.06 |
| Motor Efficiency @ 200 psi | 56.4% |
| Cylinder Bore (inches) | 1.875 |
| Cylinder Stroke (inches) | 1.592 |
| Cylinder Swept Volume (cubic inches) | 4.40 |
| Sound Level (dBA) | 70.5 |
| Heat Transfer Rate (BTU/min) | 84.1 |

FIG. 21

AIR DUCTING SHROUD FOR COOLING AN AIR COMPRESSOR PUMP AND MOTOR

CROSS-REFERENCE TO RELATED APPLICATIONS

This patent application claims benefit of the filing date under 35 USC §120 of U.S. provisional patent application No. 61/533,993 entitled "Air Ducting Shroud For Cooling An Air Compressor Pump And Motor" filed on Sep. 13, 2011. This patent application claims benefit of the filing date under 35 USC §120 of U.S. provisional patent application No. 61/534,001 entitled "Shroud For Capturing Fan Noise" filed on Sep. 13, 2011. This patent application claims benefit of the filing date under 35 USC §120 of U.S. provisional patent application No. 61/534,009 entitled "Method Of Reducing Air Compressor Noise" filed on Sep. 13, 2011. This patent application claims benefit of the filing date under 35 USC §120 of U.S. provisional patent application No. 61/534,015 entitled "Tank Dampening Device" filed on Sep. 13, 2011. This patent application claims benefit of the filing date under 35 USC §120 of U.S. provisional patent application No. 61/534,046 entitled "Compressor Intake Muffler And Filter" filed on Sep. 13, 2011.

INCORPORATION BY REFERENCE

This patent application incorporates by reference in its entirety U.S. provisional patent application No. 61/533,993 entitled "Air Ducting Shroud For Cooling An Air Compressor Pump And Motor" filed on Sep. 13, 2011. This patent application incorporates by reference in its entirety U.S. provisional patent application No. 61/534,001 entitled "Shroud For Capturing Fan Noise" filed on Sep. 13, 2011. This patent application incorporates by reference in its entirety U.S. provisional patent application No. 61/534,009 entitled "Method Of Reducing Air Compressor Noise" filed on Sep. 13, 2011. This patent application incorporates by reference in its entirety U.S. provisional patent application No. 61/534,015 entitled "Tank Dampening Device" filed on Sep. 13, 2011. This patent application incorporates by reference in its entirety U.S. provisional patent application No. 61/534,046 entitled "Compressor Intake Muffler And Filter" filed on Sep. 13, 2011.

FIELD OF THE INVENTION

The invention relates to a compressor for air, gas or gas mixtures.

BACKGROUND OF THE INVENTION

Compressors are widely used in numerous applications. Existing compressors can generate a high noise output during operation. This noise can be annoying to users and can be distracting to those in the environment of compressor operation. Non-limiting examples of compressors which generate unacceptable levels of noise output include reciprocating, rotary screw and rotary centrifugal types. Compressors which are mobile or portable and not enclosed in a cabinet or compressor room can be unacceptably noisy. However, entirely encasing a compressor, for example in a cabinet or compressor room, is expensive, prevents mobility of the compressor and is often inconvenient or not feasible. Additionally, such encasement can create heat exchange and ventilation problems. There is a strong and urgent need for a quieter compressor technology.

When a power source for a compressor is electric, gas or diesel, unacceptably high levels of unwanted heat and exhaust gases can be produced. Additionally, existing compressors can be inefficient in cooling a compressor pump and motor. Existing compressors can use multiple fans, e.g. a compressor can have one fan associated with a motor and a different fan associated with a pump. The use of multiple fans adds cost manufacturing difficulty, noise and unacceptable complexity to existing compressors. Current compressors can also have improper cooling gas flow paths which can choke cooling gas flows to the compressor and its components. Thus, there is a strong and urgent need for a more efficient cooling design for compressors.

SUMMARY OF THE INVENTION

In an embodiment, the compressor assembly disclosed herein can have a fan; a pump assembly; an air ducting shroud which directs cooling air to a member of the pump assembly and which is adapted to dampen a noise from the pump assembly; and a sound level having a value of 75 dBA or less when the compressor is in a compressing state.

The compressor assembly can have an air ducting shroud which encases at least a portion of the fan. The compressor assembly can have an air ducting shroud which encases at least a portion of a motor of the pump assembly. The compressor assembly can have an air ducting shroud which has a conduit which directs a cooling air flow to a cylinder head of the pump assembly. The compressor assembly can have an air ducting shroud which directs a cooling air flow to at least a portion of a motor of the pump assembly. The compressor assembly can have an air ducting shroud which directs a cooling air flow to at least a portion of a pump of the pump assembly. The compressor assembly can have an air ducting shroud having at least one partition which directs a cooling air flow.

The compressor assembly can have an air ducting shroud having a conduit adapted to direct a cooling air flow to a cylinder head of the pump assembly. The compressor assembly can have an air ducting shroud which directs cooling air to at least a portion of a cylinder of the pump assembly. The compressor assembly can have an air ducting shroud which encases a motor and directs a first cooling air flow to a first stator coil of a motor and which directs a second cooling air flow to a second stator of a motor and a third cooling air flow to a cylinder head of the pump assembly.

The compressor assembly can have a heat transfer rate from the pump assembly having a value in a range of 60 BTU/min or greater when the compressor is in a compressing state.

The compressor assembly can have a cooling air flow rate having a value of 50 CFM or greater when the compressor is in a compressing state.

The compressor assembly can have a motor of the pump assembly, with a motor efficiency which is greater than 45 percent.

In an aspect, the compressor assembly can be cooled by a method having the steps of: providing a fan; providing a pump assembly; cooling the pump assembly with at least a portion of a cooling air flow provided by the fan when the compressor is in a compressing state; and operating the compressor at a sound level of less than 75 dBA.

The method of cooling a compressor assembly can also have the steps of: providing a motor of the pump assembly; providing a cylinder head of the pump assembly; providing a cooling air flow to cool both the motor and the cylinder head; and orienting the motor to such that a substantial portion of the cylinder head can receive at least a portion of cooling air which has not cooled the motor.

The method of cooling a compressor assembly can also have the steps of: providing an air ducting shroud having a plurality of conduits; and feeding a cooling air through the plurality of conduits to cool a pump assembly having the motor.

A compressor assembly can have a means for directing a plurality of cooling air flows to cool a pump assembly of the compressor assembly; and a means for dampening a noise from a compressor assembly to a sound level of 75 dBA or less.

The compressor can have a means for directing a cooling air flow to a cylinder head of the pump assembly from a fan, and a means for directing a cooling air flow from the fan to a motor of the pump assembly.

The compressor can have a means for directing a cooling air flow to a cylinder of the pump assembly.

The compressor can have a means for partitioning chambers within the compressor assembly such that at least one chamber has at least a portion of trapped air.

BRIEF DESCRIPTION OF THE DRAWINGS

The present invention in its several aspects and embodiments solves the problems discussed above and significantly advances the technology of compressors. The present invention can become more fully understood from the detailed description and the accompanying drawings, wherein:

FIG. 17 is a first table of embodiments of compressor assembly ranges of performance characteristics;

FIG. 18 is a second table of embodiments of compressor assembly ranges of performance characteristics;

FIG. 19 is a first table of example performance characteristics for an example compressor assembly;

FIG. 20 is a second table of example performance characteristics for an example compressor assembly;

FIG. 21 is a table containing a third example of performance characteristics of an example compressor assembly;

Herein, like reference numbers in one figure refer to like reference numbers in another figure.

DETAILED DESCRIPTION OF THE INVENTION

Figure 2:
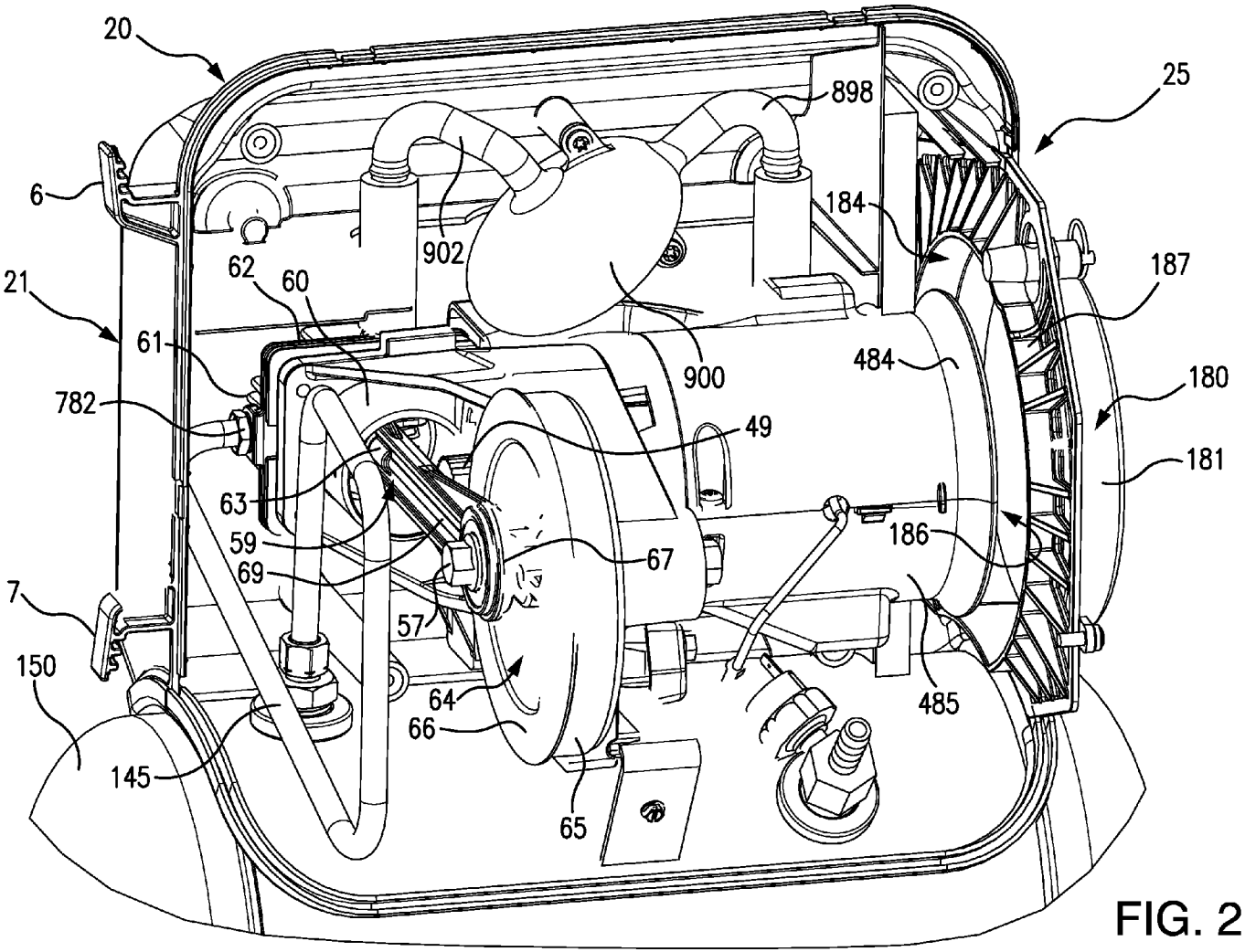
FIG. 2 is a front view of internal components of the compressor assembly.
Figure 3:
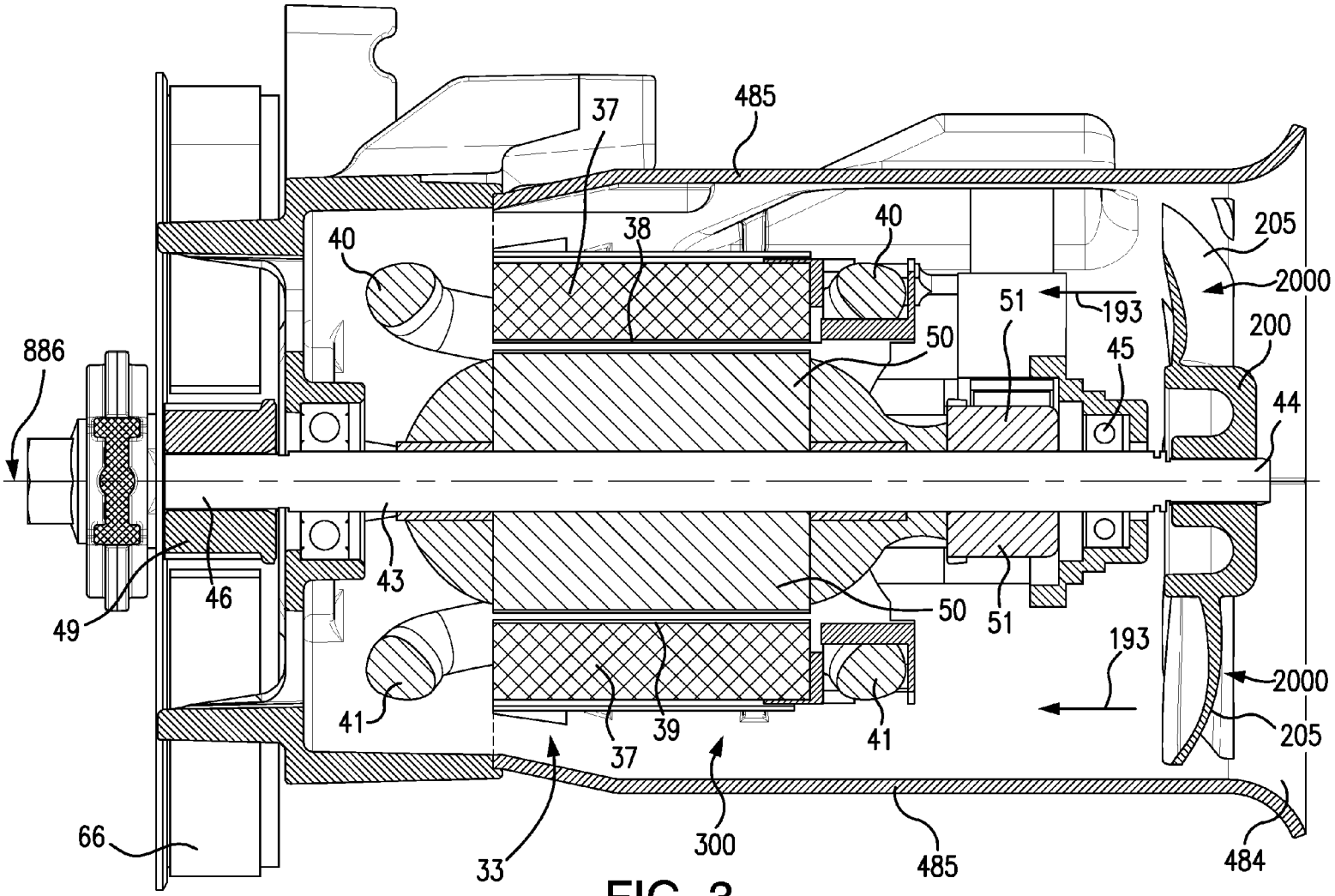
FIG. 3 is a front sectional view of the motor and fan assembly.
Figure 4:
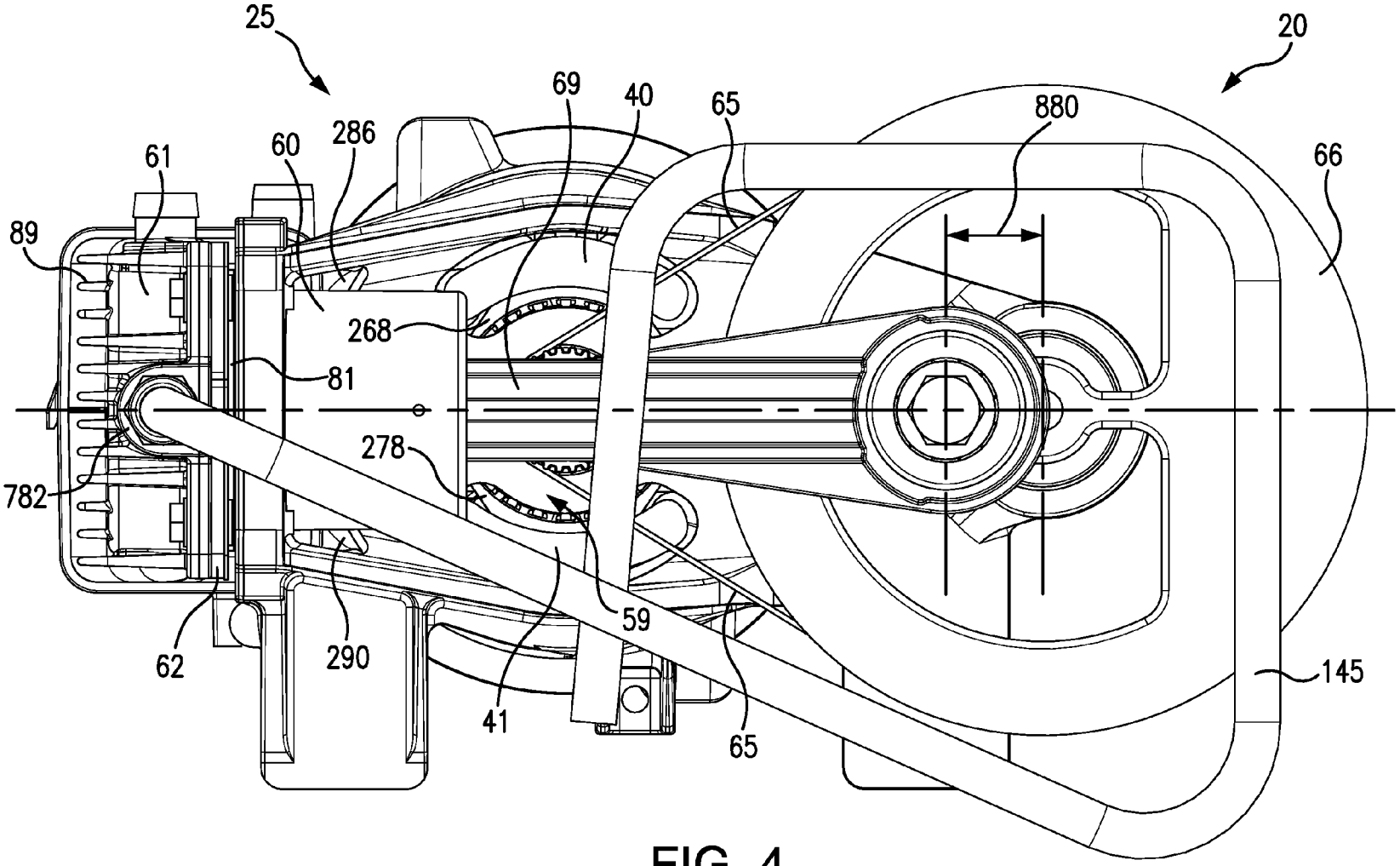
FIG. 4 is a pump-side view of components of the pump assembly.

The invention relates to a compressor assembly which can compress air, or gas, or gas mixtures, and which has a low noise output, effective cooling means and high heat transfer. The inventive compressor assembly achieves efficient cooling of the compressor assembly 20 (FIG. 1) and/or pump assembly 25 (FIG. 2) and/or the components thereof (FIGS. 3 and 4). In an embodiment, the compressor can compress air. In another embodiment, the compressor can compress one or more gases, inert gases, or mixed gas compositions. The disclosure herein regarding compression of air is also applicable to the use of the disclosed apparatus in its many embodiments and aspects in a broad variety of services and can be used to compress a broad variety of gases and gas mixtures.

Figure 1:
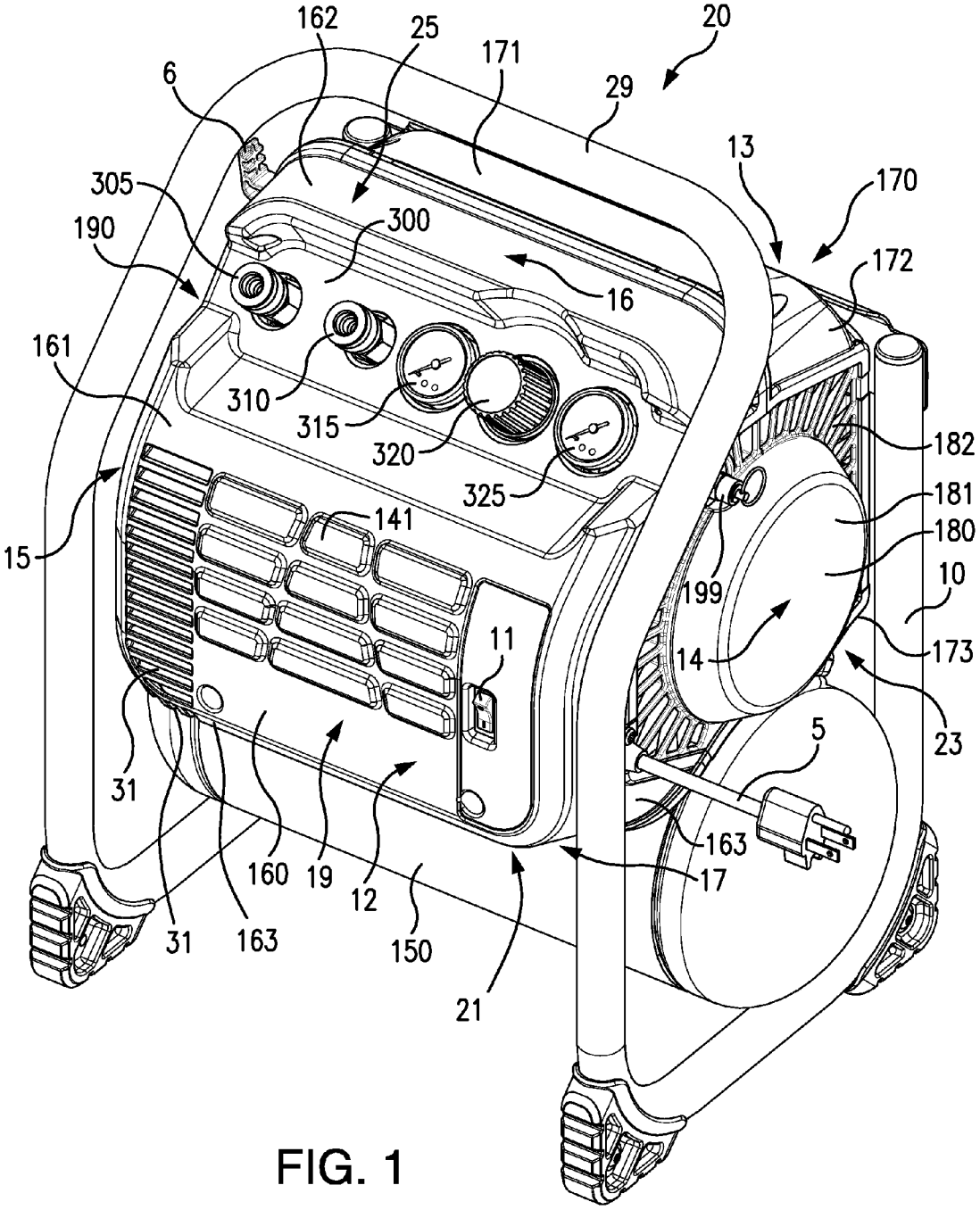
FIG. 1 is a perspective view of a compressor assembly.

FIG. 1 is a perspective view of a compressor assembly 20 shown according to the invention. In an embodiment, the compressor assembly 20 can compress air, or can compress one or more gases, or gas mixtures. In an embodiment, the compressor assembly 20 is also referred to hearing herein as "a gas compressor assembly" or "an air compressor assembly".

The compressor assembly 20 can optionally be portable. The compressor assembly 20 can optionally have a handle 29, which optionally can be a portion of frame 10.

In an embodiment, the compressor assembly 20 can have a value of weight between 15 lbs and 100 lbs. In an embodiment, the compressor assembly 20 can be portable and can have a value of weight between 15 lbs and 50 lbs. In an embodiment, the compressor assembly 20 can have a value of weight between 25 lbs and 40 lbs. In an embodiment, the compressor assembly 20 can have a value of weight of, e.g. 38 lbs, or 29 lbs, or 27 lbs, or 25 lbs, or 20 lbs, or less. In an embodiment, frame 10 can have a value of weight of 10 lbs or less. In an embodiment, frame 10 can weigh 5 lbs, or less, e.g. 4 lbs, or 3 lbs, of 2 lbs, or less.

In an embodiment, the compressor assembly 20 can have a front side 12 ("front"), a rear side 13 ("rear"), a fan side 14 ("fan-side"), a pump side 15 ("pump-side"), a top side 16 ("top") and a bottom side 17 ("bottom").

The compressor assembly 20 can have a housing 21 which can have ends and portions which are referenced herein by orientation consistently with the descriptions set forth above. In an embodiment, the housing 21 can have a front housing 160, a rear housing 170, a fan-side housing 180 and a pump-side housing 190. The front housing 160 can have a front housing portion 161, a top front housing portion 162 and a bottom front housing portion 163. The rear housing 170 can have a rear housing portion 171, a top rear housing portion 172 and a bottom rear housing portion 173. The fan-side housing 180 can have a fan cover 181 and a plurality of intake ports 182. The compressor assembly can be cooled by air flow provided by a fan 200 (FIG. 3), e.g. cooling air stream 2000 (FIG. 3).

In an embodiment, the housing 21 can be compact and can be molded. The housing 21 can have a construction at least in part of plastic, or polypropylene, acrylonitrile butadiene styrene (ABS), metal, steel, stamped steel, fiberglass, thermoset plastic, cured resin, carbon fiber, or other material. The frame 10 can be made of metal, steel, aluminum, carbon fiber, plastic or fiberglass.

Power can be supplied to the motor of the compressor assembly through a power cord 5 extending through the fan-side housing 180. In an embodiment, the compressor assembly 20 can comprise one or more of a cord holder member, e.g. first cord wrap 6 and second cord wrap 7 (FIG. 2).

In an embodiment, power switch 11 can be used to change the operating state of the compressor assembly 20 at least from an "on" to an "off" state, and vice versa. In an "on" state, the compressor can be in a compressing state (also herein as a "pumping state") in which it is compressing air, or a gas, or a plurality of gases, or a gas mixture.

Figure 7:
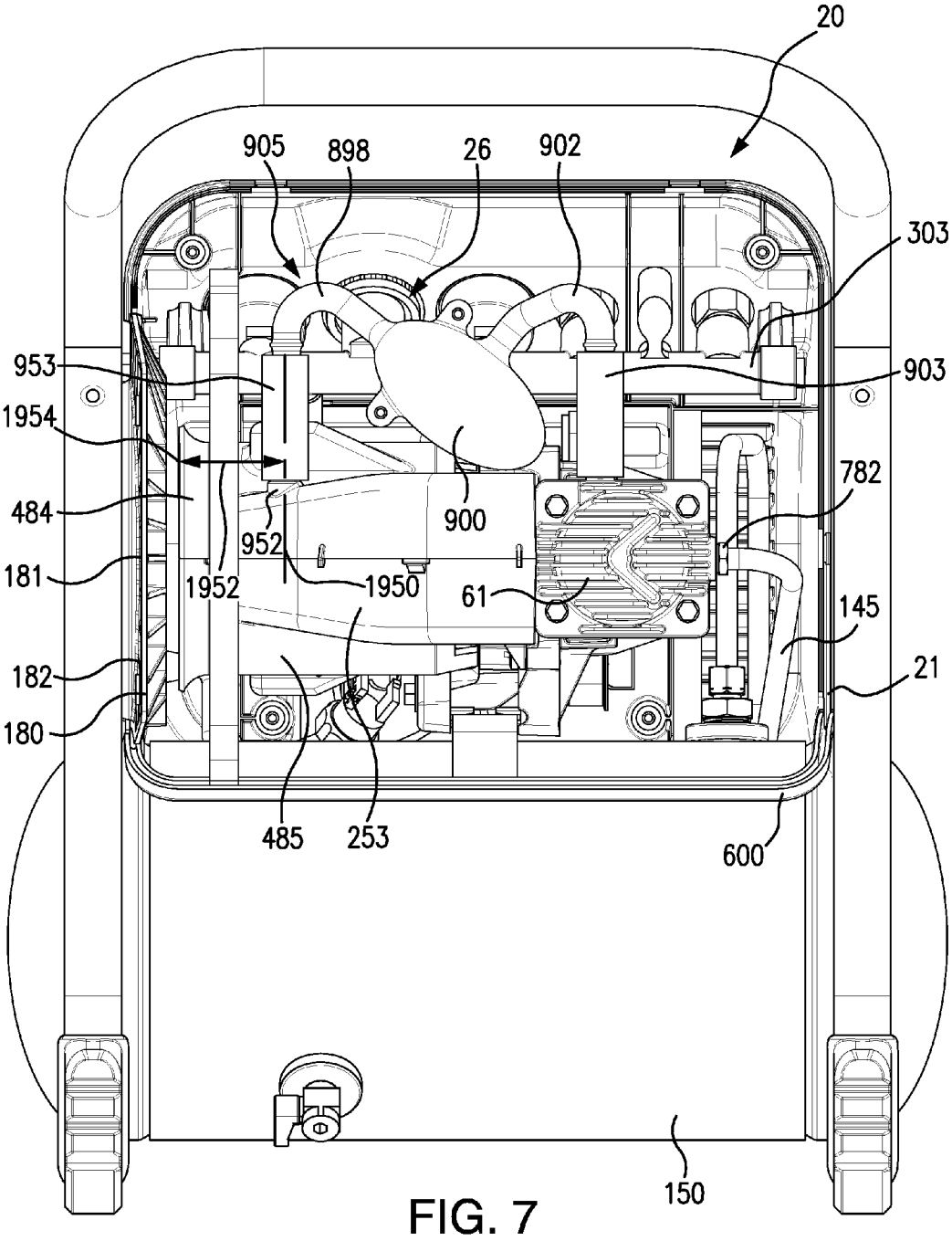
FIG. 7 is a rear view of internal components of the compressor assembly.

In an embodiment, other operating modes can be engaged by power switch 11 or a compressor control system, e.g. a standby mode, or a power save mode. In an embodiment, the front housing 160 can have a dashboard 300 which provides an operator-accessible location for connections, gauges and valves which can be connected to a manifold 303 (FIG. 7). In an embodiment, the dashboard 300 can provide an operator access in non-limiting example to a first quick connection 305, a second quick connection 310, a regulated pressure gauge 315, a pressure regulator 320 and a tank pressure gauge 325. In an embodiment, a compressed gas outlet line, hose or other device to receive compressed gas can be connected the first quick connection 305 and/or second quick connection 310. In an embodiment, as shown in FIG. 1, the frame can be configured to provide an amount of protection to the dashboard 300 from the impact of objects from at least the pump-side, fan-side and top directions.

In an embodiment, the pressure regulator 320 employs a pressure regulating valve. The pressure regulator 320 can be used to adjust the pressure regulating valve 26 (FIG. 7). The pressure regulating valve 26 can be set to establish a desired output pressure. In an embodiment, excess air pressure can be can vented to atmosphere through the pressure regulating valve 26 and/or pressure relief valve 199 (FIG. 1). In an embodiment, pressure relief valve 199 can be a spring loaded safety valve. In an embodiment, the air compressor assembly 20 can be designed to provide an unregulated compressed air output.

In an embodiment, the pump assembly 25 and the compressed gas tank 150 can be connected to frame 10. The pump assembly 25, housing 21 and compressed gas tank 150 can be connected to the frame 10 by a plurality of screws and/or one or a plurality of welds and/or a plurality of connectors and/or fasteners.

The plurality of intake ports 182 can be formed in the housing 21 adjacent the housing inlet end 23 and a plurality of exhaust ports 31 can be formed in the housing 21. In an embodiment, the plurality of the exhaust ports 31 can be placed in housing 21 in the front housing portion 161. Optionally, the exhaust ports 31 can be located adjacent to the pump end of housing 21 and/or the pump assembly 25 and/or the pump cylinder 60 and/or cylinder head 61 (FIG. 2) of the pump assembly 25. In an embodiment, the exhaust ports 31 can be provided in a portion of the front housing portion 161 and in a portion of the bottom front housing portion 163.

The total cross-sectional open area of the intake ports 182 (the sum of the cross-sectional areas of the individual intake ports 182) can be a value in a range of from 3.0 in^2 to 100 in^2. In an embodiment, the total cross-sectional open area of the intake ports 182 can be a value in a range of from 6.0 in^2 to 38.81 in^2. In an embodiment, the total cross-sectional open area of the intake ports 182 can be a value in a range of from 9.8 in^2 to 25.87 in^2. In an embodiment, the total cross-sectional open area of the intake ports 182 can be 12.936 in^2.

In an embodiment, the cooling gas employed to cool compressor assembly 20 and its components can be air (also known herein as "cooling air"). The cooling air can be taken in from the environment in which the compressor assembly 20 is placed. The cooling air can be ambient from the natural environment, or air which has been conditioned or treated. The definition of "air" herein is intended to be very broad. The term "air" includes breathable air, ambient air, treated air, conditioned air, clean room air, cooled air, heated air, non-flammable oxygen containing gas, filtered air, purified air, contaminated air, air with particulates solids or water, air from bone dry (i.e. 0.00 humidity) air to air which is supersaturated with water, as well as any other type of air present in an environment in which a gas (e.g. air) compressor can be used. It is intended that cooling gases which are not air are encompassed by this disclosure. For non-limiting example, a cooling gas can be nitrogen, can comprise a gas mixture, can comprise nitrogen, can comprise oxygen (in a safe concentration), can comprise carbon dioxide, can comprise one inert gas or a plurality of inert gases, or comprise a mixture of gases.

In an embodiment, cooling air can be exhausted from compressor assembly 20 through a plurality of exhaust ports 31. The total cross-sectional open area of the exhaust ports 31 (the sum of the cross-sectional areas of the individual exhaust ports 31) can be a value in a range of from 3.0 in^2 to 100 in^2. In an embodiment, the total cross-sectional open area of the exhaust ports can be a value in a range of from 3.0 in^2 to 77.62 in^2. In an embodiment, the total cross-sectional open area of the exhaust ports can be a value in a range of from 4.0 in^2 to 38.81 in^2. In an embodiment, the total cross-sectional open area of the exhaust ports can be a value in a range of from 4.91 in^2 to 25.87 in^2. In an embodiment, the total cross-sectional open area of the exhaust ports can be 7.238 in^2.

Numeric values and ranges herein, unless otherwise stated, also are intended to have associated with them a tolerance and to account for variances of design and manufacturing, and/or operational and performance fluctuations. Thus, a number disclosed herein is intended to disclose values "about" that number. For example, a value X is also intended to be understood as "about X". Likewise, a range of Y-Z is also intended to be understood as within a range of from "about Y-about Z". Unless otherwise stated, significant digits disclosed for a number are not intended to make the number an exact limiting value. Variance and tolerance, as well as operational or performance fluctuations, are an expected aspect of mechanical design and the numbers disclosed herein are intended to be construed to allow for such factors (in non-limiting e.g., ±10 percent of a given value). This disclosure is to be broadly construed. Likewise, the claims are to be broadly construed in their recitations of numbers and ranges.

The compressed gas tank 150 can operate at a value of pressure in a range of at least from ambient pressure, e.g. 14.7 psig to 3000 psig ("psig" is the unit lbf/in^2 gauge), or greater. In an embodiment, compressed gas tank 150 can operate at 200 psig. In an embodiment, compressed gas tank 150 can operate at 150 psig.

In an embodiment, the compressor has a pressure regulated on/off switch which can stop the pump when a set pressure is obtained. In an embodiment, the pump is activated when the pressure of the compressed gas tank 150 falls to 70 percent of the set operating pressure, e.g. to activate at 140 psig with an operating set pressure of 200 psig (140 psig=0.70*200 psig). In an embodiment, the pump is activated when the pressure of the compressed gas tank 150 falls to 80 percent of the set operating pressure, e.g. to activate at 160 psig with an operating set pressure of 200 psig (160 psig=0.80*200 psig). Activation of the pump can occur at a value of pressure in a wide range of set operating pressure, e.g. 25 percent to 99.5 percent of set operating pressure. Set operating pressure can also be a value in a wide range of pressure, e.g. a value in a range of from 25 psig to 3000 psig. An embodiment of set pressure can be 50 psig, 75 psig, 100 psig, 150 psig, 200 psig, 250 psig, 300 psig, 500 psig, 1000 psig, 2000 psig, 3000 psig, or greater than or less than, or a value in between these example numbers.

The compressor assembly 20 disclosed herein in its various embodiments achieves a reduction in the noise created by the vibration of the air tank while the air compressor is running, in its compressing state (pumping state) e.g. to a value in a range of from 60-75 dBA, or less, as measured by ISO3744-1995. Noise values discussed herein are compliant with ISO3744-1995. ISO3744-1995 is the standard for noise data and results for noise data, or sound data, provided in this application. Herein "noise" and "sound" are used synonymously.

The pump assembly 25 can be mounted to an air tank and can be covered with a housing 21. A plurality of optional decorative shapes 141 can be formed on the front housing portion 161. The plurality of optional decorative shapes 141 can also be sound absorbing and/or vibration dampening shapes. The plurality of optional decorative shapes 141 can optionally be used with, or contain at least in part, a sound absorbing material.

FIG. 2 is a front view of internal components of the compressor assembly.

The compressor assembly 20 can include a pump assembly 25. In an embodiment, pump assembly 25 which can compress a gas, air or gas mixture. In an embodiment in which the pump assembly 25 compresses air, it is also referred to herein as air compressor 25, or compressor 25. In an embodiment, the pump assembly 25 can be powered by a motor 33 (e.g. FIG. 3).

FIG. 2 illustrates the compressor assembly 20 with a portion of the housing 21 removed and showing the pump assembly 25. In an embodiment, the fan-side housing 180 can have a fan cover 181 and a plurality of intake ports 182. The cooling gas, for example air, can be fed through an air inlet space 184 which feeds air into the fan 200 (e.g. FIG. 3). In an embodiment, the fan 200 can be housed proximate to an air intake port 186 of an air ducting shroud 485.

Air ducting shroud 485 can have a shroud inlet scoop 484. As illustrated in FIG. 2, air ducting shroud 485 is shown encasing the fan 200 and the motor 33 (FIG. 3). In an embodiment, the shroud inlet scoop 484 can encase the fan 200, or at least a portion of the fan and at least a portion of motor 33. In this embodiment, an air inlet space 184 which feeds air into the fan 200 is shown. The air ducting shroud 485 can encase the fan 200 and the motor 33, or at least a portion of these components.

FIG. 2 is an intake muffler 900 which can receive feed air for compression (also herein as "feed air 990"; e.g. FIG. 8) via the intake muffler feed line 898. The feed air 990 can pass through the intake muffler 900 and be fed to the cylinder head 61 via the muffler outlet line 902. The feed air 990 can be compressed in pump cylinder 60 by piston 63. The piston can be provided with a seal which can function, such as slide, in the cylinder without liquid lubrication. The cylinder head 61 can be shaped to define an inlet chamber 81 (e.g. FIG. 9) and an outlet chamber 82 (e.g. FIG. 8) for a compressed gas, such as air (also known herein as "compressed air 999" or "compressed gas 999"; e.g. FIG. 10). In an embodiment, the pump cylinder 60 can be used as at least a portion of an inlet chamber 81. A gasket can form an air tight seal between the cylinder head 61 and the valve plate assembly 62 to prevent a leakage of a high pressure gas, such as compressed air 999, from the outlet chamber 82. Compressed air 999 can exit the cylinder head 61 via a compressed gas outlet port 782 and can pass through a compressed gas outlet line 145 to enter the compressed gas tank 150.

Figure 9:
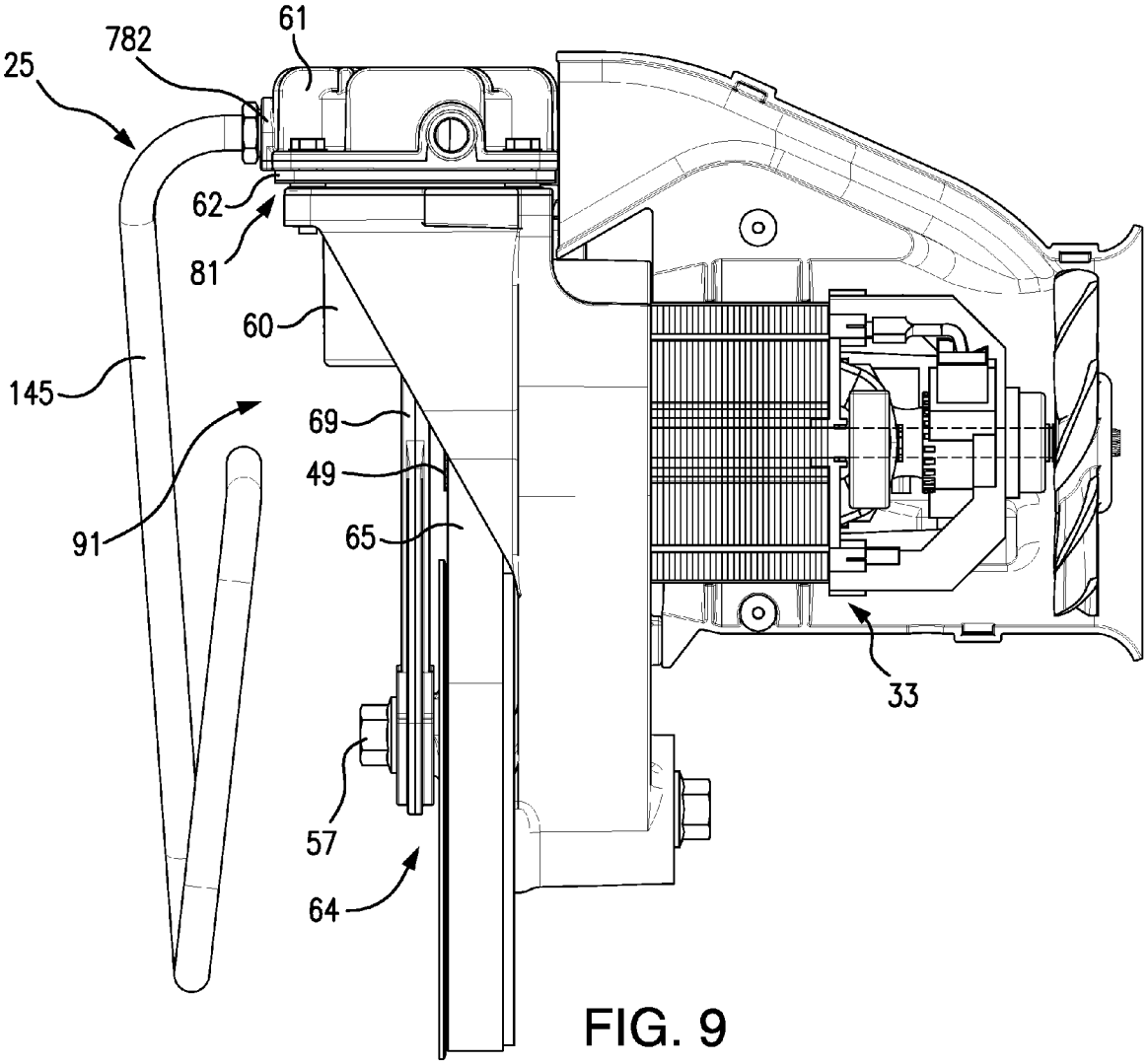
FIG. 9 is a top view of components of the pump assembly.

As shown in FIG. 2, the pump assembly 25 can have a pump cylinder 60, a cylinder head 61, a valve plate assembly 62 mounted between the pump cylinder 60 and the cylinder head 61, and a piston 63 which is reciprocated in the pump cylinder 60 by an eccentric drive 64 (e.g. FIG. 9). The eccentric drive 64 can include a sprocket 49 which can drive a drive belt 65 which can drive a pulley 66. A bearing 67 can be eccentrically secured to the pulley 66 by a screw, or a rod bolt 57, and a connecting rod 69. Preferably, the sprocket 49 and the pulley 66 can be spaced around their perimeters and the drive belt 65 can be a timing belt. The pulley 66 can be mounted about pulley centerline 887 and linked to a sprocket 49 by the drive belt 65 (FIG. 3) which can be configured on an axis which is represent herein as a shaft centerline 886 supported by a bracket and by a bearing 47 (FIG. 3). A bearing can allow the pulley 66 to be rotated about an axis 887 (FIG. 10) when the motor rotates the sprocket 49. As the pulley 66 rotates about the axis 887 (FIG. 10), the bearing 67 (FIG. 2) and an attached end of the connecting rod 69 are moved around a circular path.

The piston 63 can be formed as an integral part of the connecting rod 69. A compression seal can be attached to the piston 63 by a retaining ring and a screw. In an embodiment, the compression seal can be a sliding compression seal.

A cooling gas stream, such as cooling air stream 2000 (FIG. 3), can be drawn through intake ports 182 to feed fan 200. The cooling air stream 2000 can be divided into a number of different cooling air stream flows which can pass through portions of the compressor assembly and exit separately, or collectively as an exhaust air steam through the plurality of exhaust ports 31. Additionally, the cooling gas, e.g. cooling air stream 2000, can be drawn through the plurality of intake ports 182 and directed to cool the internal components of the compressor assembly 20 in a predetermined sequence to optimize the efficiency and operating life of the compressor assembly 20. The cooling air can be heated by heat transfer from compressor assembly 20 and/or the components thereof, such as pump assembly 25 (FIG. 3).

The heated air can be exhausted through the plurality of exhaust ports 31.

In an embodiment, one fan can be used to cool both the pump and motor. A design using a single fan to provide cooling to both the pump and motor can require less air flow than a design using two or more fans, e.g. using one or more fans to cool the pump, and also using one or more fans to cool the motor. Using a single fan to provide cooling to both the pump and motor can reduce power requirements and also reduces noise production as compared to designs using a plurality of fans to cool the pump and the motor, or which use a plurality of fans to cool the pump assembly 25, or the compressor assembly 20.

In an embodiment, the fan blade 205 (e.g. FIG. 3) establishes a forced flow of cooling air through the internal housing, such as the air ducting shroud 485. The cooling air flow through the air ducting shroud can be a volumetric flow rate having a value of between 25 CFM to 400 CFM. The cooling air flow through the air ducting shroud can be a volumetric flow rate having a value of between 45 CFM to 125 CFM.

In an embodiment, the outlet pressure of cooling air from the fan can be in a range of from 1 psig to 50 psig. In an embodiment, the fan 200 can be a low flow fan with which generates an outlet pressure having a value in a range of from 1 in of water to 10 psi. In an embodiment, the fan 200 can be a low flow fan with which generates an outlet pressure having a value in a range of from 2 in of water to 5 psi.

In an embodiment, the air ducting shroud 485 can flow 100 CFM of cooling air with a pressure drop of from 0.0002 psi to 50 psi along the length of the air ducting shroud. In an embodiment, the air ducting shroud 485 can flow 75 CFM of cooling air with a pressure drop of 0.028 psi along its length as measured from the entrance to fan 200 through the exit from conduit 253 (FIG. 7).

In an embodiment, the air ducting shroud 485 can flow 75 CFM of cooling air with a pressure drop of 0.1 psi along its length as measured from the outlet of fan 200 through the exit from conduit 253. In an embodiment, the air ducting shroud 485 can flow 100 CFM of cooling air with a pressure drop of 1.5 psi along its length as measured from the outlet of fan 200 through the exit from conduit 253. In an embodiment, the air ducting shroud 485 can flow 150 CFM of cooling air with a pressure drop of 5.0 psi along its length as measured from the outlet of fan 200 through the exit from conduit 253.

In an embodiment, the air ducting shroud 485 can flow 75 CFM of cooling air with a pressure drop in a range of from 1.0 psi to 30 psi across as measured from the outlet of fan 200 across the motor 33.

Depending upon the compressed gas output, the design rating of the motor 33 and the operating voltage, in an embodiment the motor 33 can operate at a value of rotation (motor speed) between 5,000 rpm and 20,000 rpm. In an embodiment, the motor 33 can operate at a value in a range of between 7,500 rpm and 12,000 rpm. In an embodiment, the motor 33 can operate at e.g. 11,252 rpm, or 11,000 rpm; or 10,000 rpm; or 9,000 rpm; or 7,500; or 6,000 rpm; or 5,000 rpm. The pulley 66 and the sprocket 49 can be sized to achieve reduced pump speeds (also herein as "reciprocation rates", or "piston speed") at which the piston 63 is reciprocated. For example, if the sprocket 49 can have a diameter of 1 in and the pulley 66 can have a diameter of 4 in, then a motor 33 speed of 14,000 rpm can achieve a reciprocation rate, or a piston speed, of 3,500 strokes per minute. In an embodiment, if the sprocket 49 can have a diameter of 1.053 in and the pulley 66 can have a diameter of 5.151 in, then a motor 33 speed of 11,252 rpm can achieve a reciprocation rate, or a piston speed (pump speed), of 2,300 strokes per minute.

FIG. 3 is a front sectional view of the motor and fan assembly.

FIG. 3 illustrates the fan 200 and motor 33 covered by air ducting shroud 485. The fan 200 is shown proximate to a shroud inlet scoop 484.

The motor can have a stator 37 with an upper pole 38 around which upper stator coil 40 is wound and/or configured. The motor can have a stator 37 with a lower pole 39 around which lower stator coil 41 is wound and/or configured. A shaft 43 can be supported adjacent a first shaft end 44 by a bearing 45 and is supported adjacent to a second shaft end 46 by a bearing 47. A plurality of fan blades 205 can be secured to the fan 200 which can be secured to the first shaft end 44. When power is applied to the motor 33, the shaft 43 rotates at a high speed to in turn drive the sprocket 49 (FIG. 2), the drive belt 65 (FIG. 4), the pulley 66 (FIG. 4) and the fan blade 200. In an embodiment, the motor can be a non-synchronous universal motor. In an embodiment, the motor can be a synchronous motor used.

The compressor assembly 20 can be designed to accommodate a variety of types of motor 33. The motors 33 can come from different manufacturers and can have horsepower ratings of a value in a wide range from small to very high. In an embodiment, a motor 33 can be purchased from the existing market of commercial motors. For example, although the housing 21 is compact, in an embodiment it can accommodate a universal motor, or other motor type, rated, for example, at ½ horsepower, at ¾ horsepower or 1 horsepower by scaling and/or designing the air ducting shroud 485 to accommodate motors in a range from small to very large.

FIG. 3 and FIG. 4 illustrate the compression system for the compressor which is also referred to herein as the pump assembly 25. The pump assembly 25 can have a pump 59, a pulley 66, drive belt 65 and driving mechanism driven by motor 33. The connecting rod 69 can connect to a piston 63 (e.g. FIG. 10) which can move inside of the pump cylinder 60.

In one embodiment, the pump 59 such as "gas pump" or "air pump" can have a piston 63, a pump cylinder 60, in which a piston 63 reciprocates and a cylinder rod 69 (FIG. 2) which can optionally be oil-less and which can be driven to compress a gas, e.g. air. The pump 59 can be driven by a high speed universal motor, e.g. motor 33 (FIG. 3), or other type of motor.

FIG. 4 is a pump-side view of components of the pump assembly 25. The "pump assembly 25" can have the components which are attached to the motor and/or which serve to compress a gas; which in non-limiting example can comprise the fan, the motor 33, the pump cylinder 60 and piston 63 (and its driving parts), the valve plate assembly 62, the cylinder head 61 and the outlet of the cylinder head 782. Herein, the feed air system 905 system (FIG. 7) is referred to separately from the pump assembly 25.

FIG. 4 illustrates that pulley 66 is driven by the motor 33 using drive belt 65.

FIG. 4 (also see FIG. 10) illustrates an offset 880 which has a value of distance which represents one half (½) of the stroke distance. The offset 880 can have a value between 0.25 in and 6 in, or larger. In an embodiment, the offset 880 can have a value between 0.75 in and 3 in. In an embodiment, the offset 880 can have a value between 1.0 in and 2 in, e.g. 1.25 in. In an embodiment, the offset 880 can have a value of about 0.796 in. In an embodiment, the offset 880 can have a value of about 0.5 in. In an embodiment, the offset 880 can have a value of about 1.5 in.

A stroke having a value in a range of from 0.50 in and 12 in, or larger can be used. A stroke having a value in a range of from 1.5 in and 6 in can be used. A stroke having a value in a range of from 2 in and 4 in can be used. A stroke of 2.5 in can be used. In an embodiment, the stroke can be calculated to equal two (2) times the offset, for example, an offset 880 of 0.796 produces a stroke of 2(0.796)=1.592 in. In another example, an offset 880 of 2.25 produces a stroke of 2(2.25)=4.5 in. In yet another example, an offset 880 of 0.5 produces a stroke of 2(0.5)=1.0 in.

The compressed air passes through valve plate assembly 62 and into the cylinder head 61 having a plurality of cooling fins 89. The compressed gas is discharged from the cylinder head 61 through the outlet line 145 which feeds compressed gas to the compressed gas tank 150.

FIG. 4 also identifies the pump-side of upper motor path 268 which can provide cooling air to upper stator coil 40 and lower motor path 278 which can provide cooling to lower stator coil 41.

Figure 5:
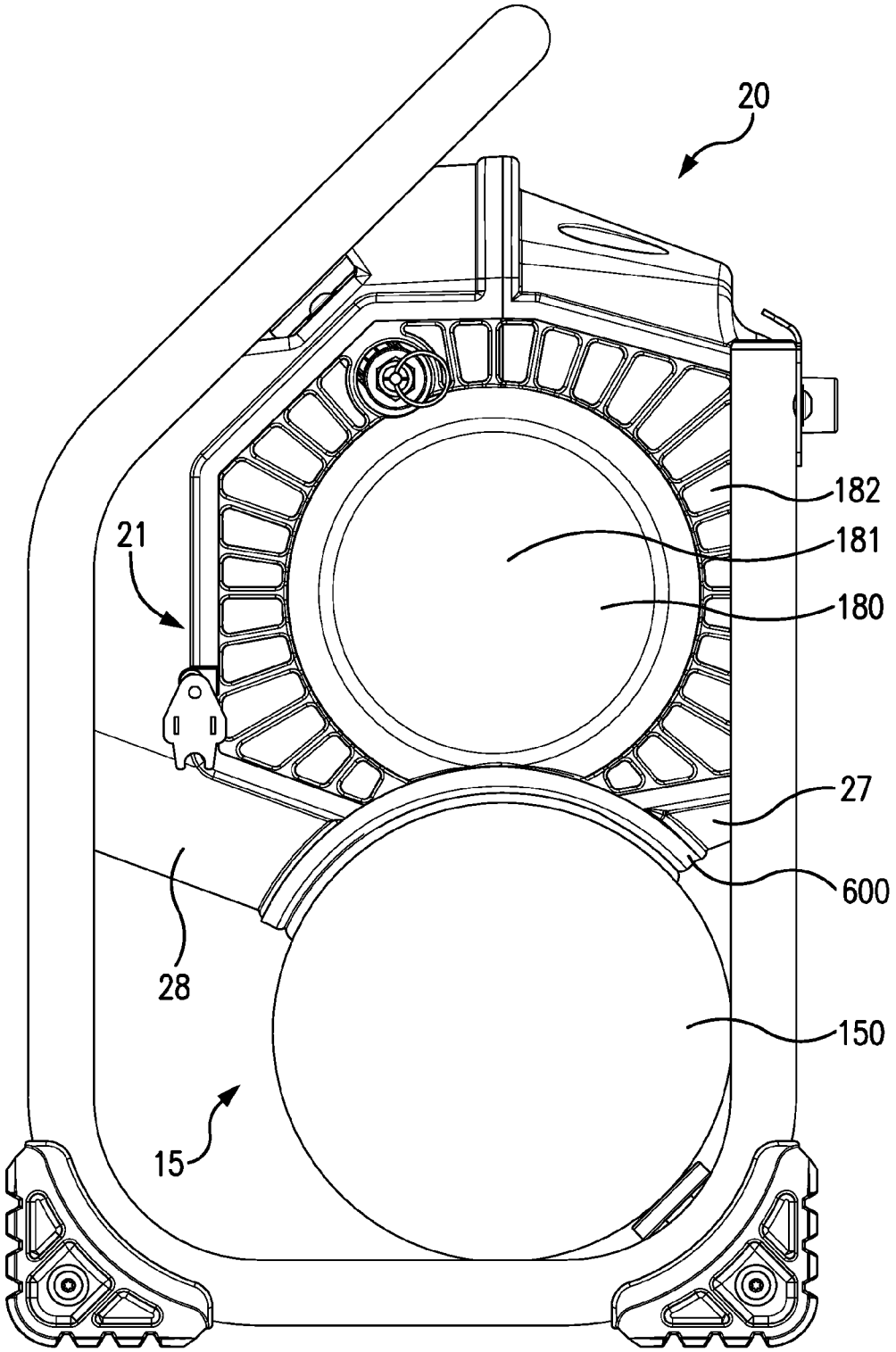
FIG. 5 is a fan-side perspective of the compressor assembly.

FIG. 5 illustrates tank seal 600 providing a seal between the housing 21 and compressed gas tank 150 viewed from fan-side 14. FIG. 5 is a fan-side perspective of the compressor assembly 20. FIG. 5 illustrates a fan-side housing 180 having a fan cover 181 with intake ports 182. FIG. 5 also shows a fan-side view of the compressed gas tank 150. Tank seal 600 is illustrated sealing the housing 21 to the compressed gas tank 150. Tank seal 600 can be a one piece member or can have a plurality of segments which form tank seal 600.

Figure 6:
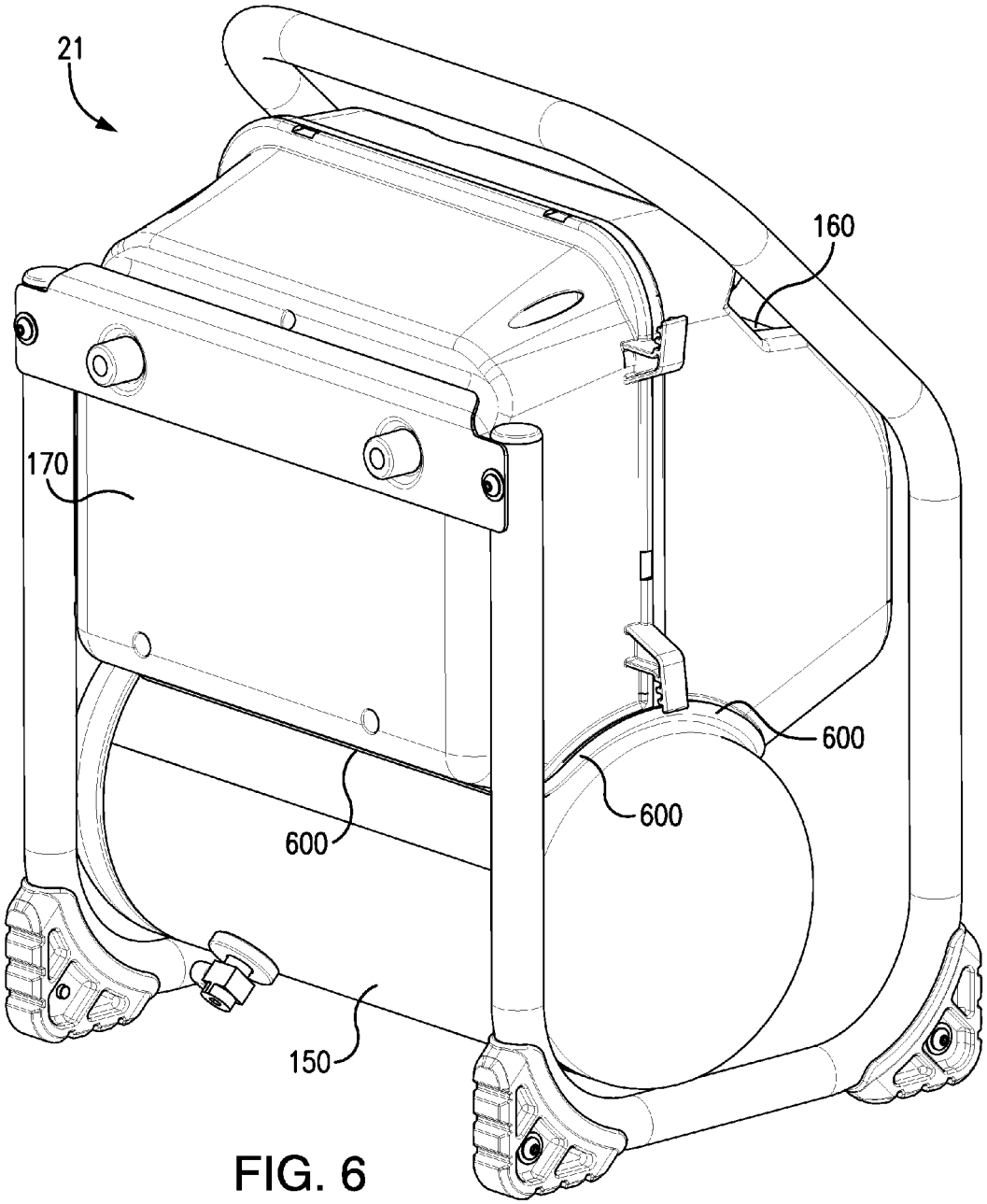
FIG. 6 is a rear perspective of the compressor assembly.

FIG. 6 is a rear-side perspective of the compressor assembly 20. FIG. 6 illustrates a tank seal 600 sealing the housing 21 to the compressed gas tank 150.

FIG. 7 is a rear view of internal components of the compressor assembly. In this sectional view, in which the rear housing 170 is not shown, the fan-side housing 180 has a fan cover 181 and intake ports 182. The fan-side housing 180 is configured to feed air to air ducting shroud 485. Air ducting shroud 485 has shroud inlet scoop 484 and conduit 253 which can feed a cooling gas, such as air, to the cylinder head 61 and pump cylinder 60.

Figure 8:
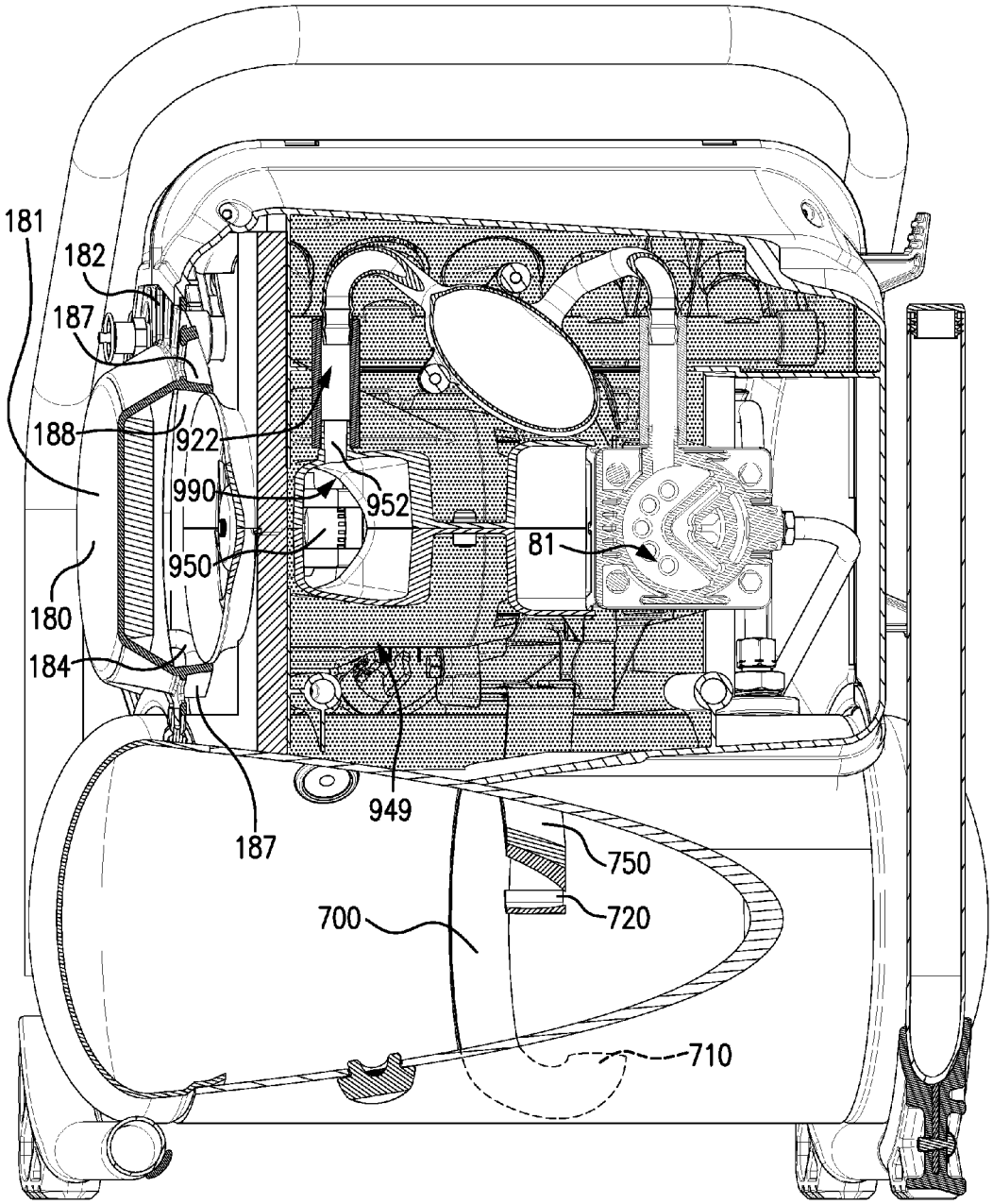
FIG. 8 is a rear sectional view of the compressor assembly.

FIG. 7 also provides a view of the feed air system 905. The feed air system 905 can feed a feed air 990 through a feed air port 952 for compression in the pump cylinder 60 of pump assembly 25. The feed air port 952 can optionally receive a clean air feed from an inertia filter 949 (FIG. 8). The clean air feed can pass through the feed air port 952 to flow through an air intake hose 953 and an intake muffler feed line 898 to the intake muffler 900. The clean air can flow from the intake muffler 900 through muffler outlet line 902 and cylinder head hose 903 to feed pump cylinder head 61. Noise can be generated by the compressor pump, such as when the piston forces air in and out of the valves of valve plate assembly 62. The intake side of the pump can provide a path for the noise to escape from the compressor which intake muffler 900 can serve to muffle.

The filter distance 1952 between an inlet centerline 1950 of the feed air port 952 and a scoop inlet 1954 of shroud inlet scoop 484 can vary widely and have a value in a range of from 0.5 in to 24 in, or even greater for larger compressor assemblies. The filter distance 1952 between inlet centerline 1950 and inlet cross-section of shroud inlet scoop 484 identified as scoop inlet 1954 can be e.g. 0.5 in, or 1.0 in, or 1.5 in, or 2.0 in, or 2.5 in, or 3.0 in, or 4.0 in, or 5.0 in or 6.0 in, or greater. In an embodiment, the filter distance 1952 between inlet centerline 1950 and inlet cross-section of shroud inlet scoop 484 identified as scoop inlet 1954 can be 1.859 in. In an embodiment, the inertia filter can have multiple inlet ports which can be located at different locations of the air ducting shroud 485. In an embodiment, the inertial filter is separate from the air ducting shroud and its feed is derived from one or more inlet ports.

FIG. 7 illustrates that compressed air can exit the cylinder head 61 via the compressed gas outlet port 782 and pass through the compressed gas outlet line 145 to enter the compressed gas tank 150. FIG. 7 also shows a rear-side view of manifold 303.

FIG. 8 is a rear sectional view of the compressor assembly 20. FIG. 8 illustrates the fan cover 181 having a plurality of intake ports 182. A portion of the fan cover 181 can be extended toward the shroud inlet scoop 484, e.g. the rim 187. In this embodiment, the fan cover 181 has a rim 187 which can eliminate a visible line of sight to the air inlet space 184 from outside of the housing 21. In an embodiment, the rim 187 can cover or overlap an air space 188. FIG. 8 illustrates an inertia filter 949 having an inertia filter chamber 950 and air intake path 922.

In an embodiment, the rim 187 can extend past the air inlet space 184 and overlaps at least a portion of the shroud inlet scoop 484. In an embodiment, the rim 187 does not extend past and does not overlap a portion of the shroud inlet scoop 484 and the air inlet space 184 can have a width between the rim 187 and a portion of the shroud inlet scoop 484 having a value of distance in a range of from 0.1 in to 2 in, e.g. 0.25 in, or 0.5 in. In an embodiment, the air ducting shroud 485 and/or the shroud inlet scoop 484 can be used to block line of sight to the fan 200 and the pump assembly 25 in conjunction with or instead of the rim 187.

The inertia filter 949 can provide advantages over the use of a filter media which can become plugged with dirt and/or particles and which can require replacement to prevent degrading of compressor performance. Additionally, filter media, even when it is new, creates a pressure drop and can reduce compressor performance.

Air must make a substantial change in direction from the flow of cooling air to become compressed gas feed air to enter and pass through the feed air port 952 to enter the air intake path 922 from the inertia filter chamber 950 of the inertia filter 949. Any dust and other particles dispersed in the flow of cooling air have sufficient inertia that they tend to continue moving with the cooling air rather than change direction and enter the air intake path 922.

FIG. 8 also shows a section of a dampening ring 700. The dampening ring 700 can optionally have a cushion member 750, as well as optionally a first hook 710 and a second hook 720.

FIG. 9 is a top view of the components of the pump assembly 25.

Pump assembly 25 can have a motor 33 which can drive the shaft 43 which causes a sprocket 49 to drive a drive belt 65 to rotate a pulley 66. The pulley 66 can be connected to and can drive the connecting rod 69 which has a piston 63 (FIG. 2) at an end. The piston 63 can compress a gas in the pump cylinder 60 pumping the compressed gas through the valve plate assembly 62 into the cylinder head 61 and then out through a compressed gas outlet port 782 through an outlet line 145 and into the compressed gas tank 150.

FIG. 9 also shows a pump 91. Herein, pump 91 collectively refers to a combination of parts including the cylinder head 61, the pump cylinder 60, the piston 63 and the connecting rod having the piston 63, as well as the components of these parts.

Figure 10:
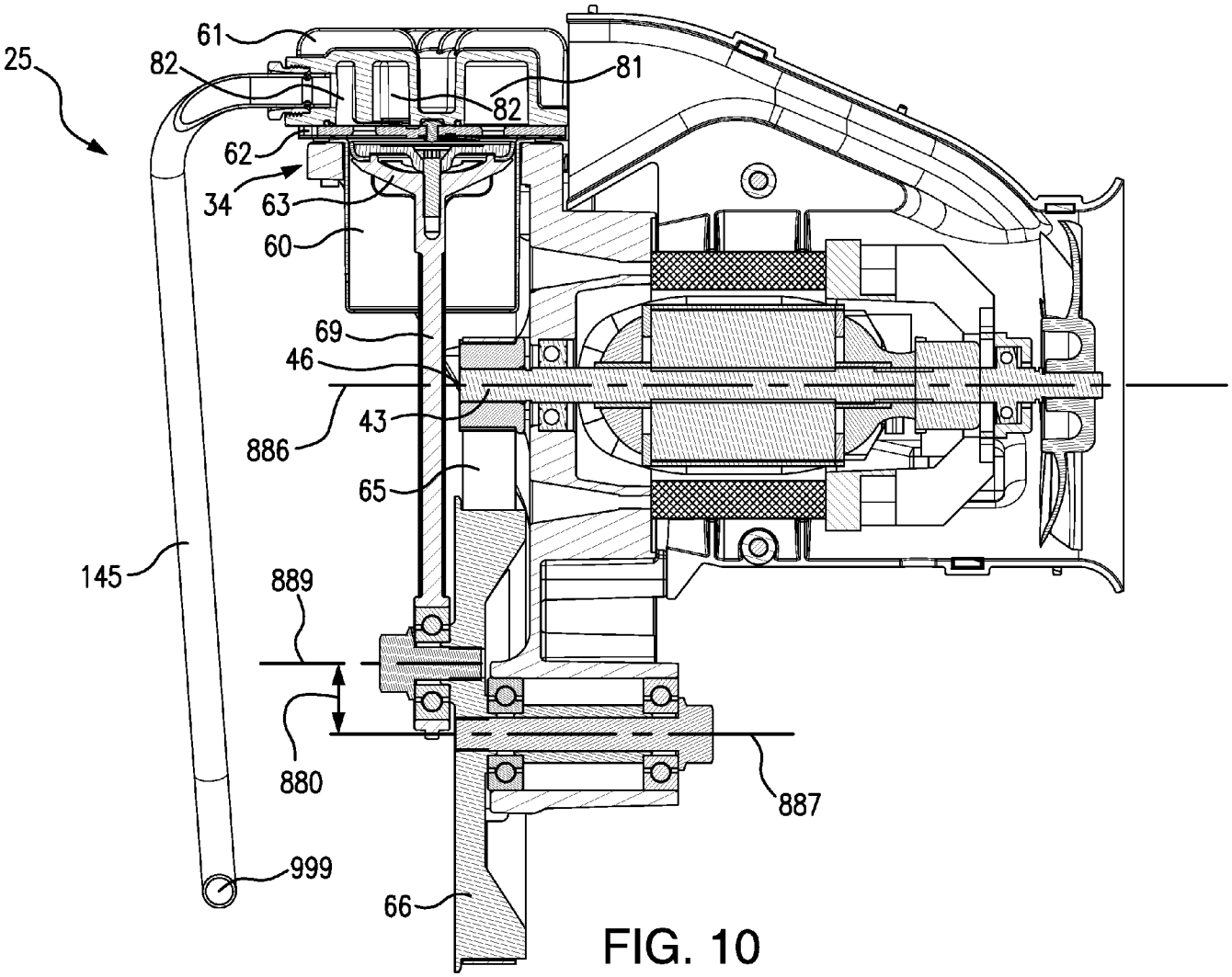
FIG. 10 is a top sectional view of the pump assembly.

FIG. 10 is a top sectional view of the pump assembly 25. FIG. 10 also shows a shaft centerline 886, as well as pulley centerline 887 and a rod bolt centerline 889 of a rod bolt 57. FIG. 10 illustrates an offset 880 which can be a dimension having a value in the range of 0.5 in to 12 in, or greater. In an embodiment, the stroke can be 1.592 in, from an offset 880 of 0.796 in. FIG. 10 also shows air inlet chamber 81.

Figure 11:
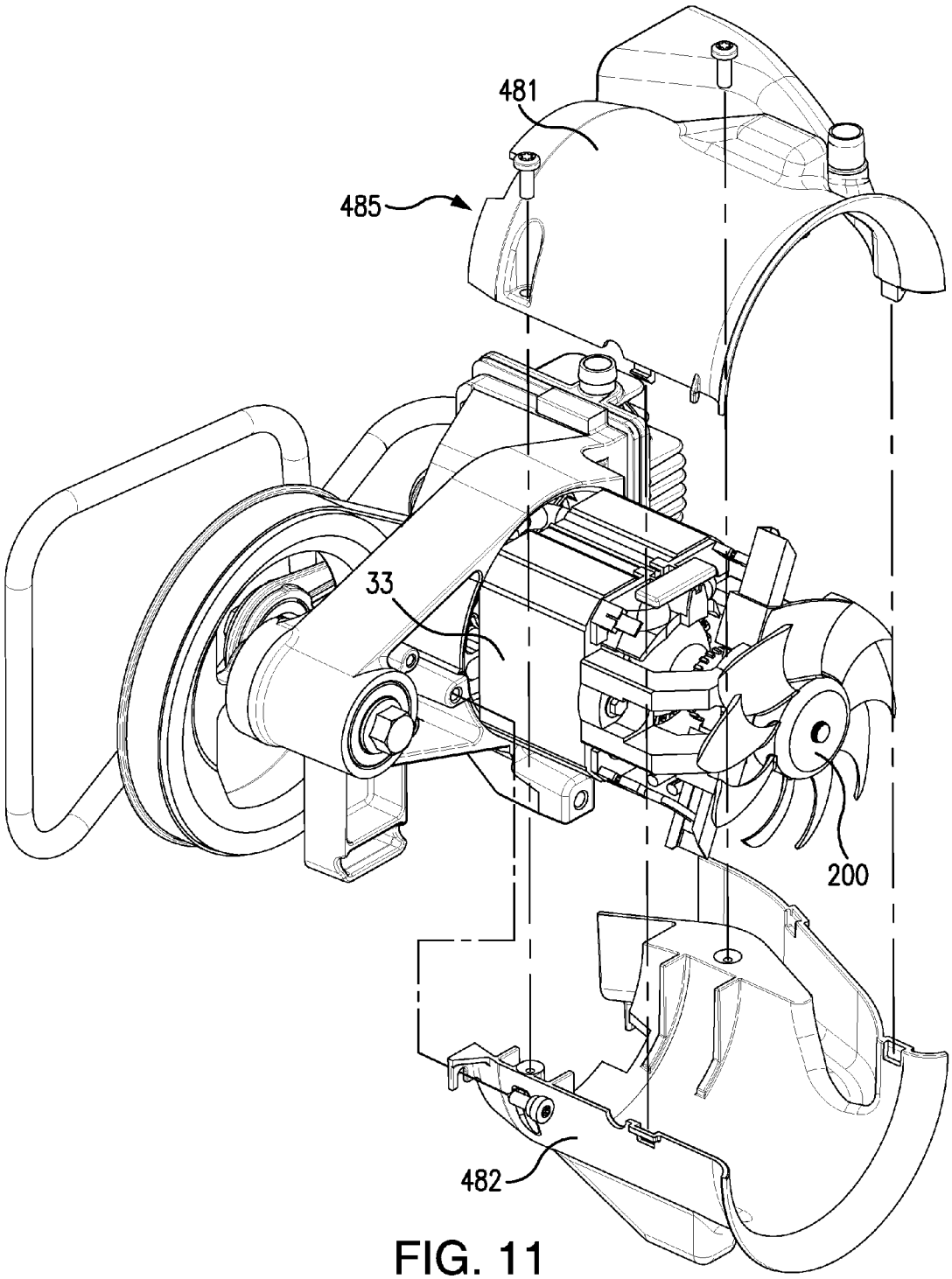
FIG. 11 is an exploded view of the air ducting shroud.

FIG. 11 illustrates an exploded view of the air ducting shroud 485. In an embodiment, the air ducting shroud 485 can have an upper ducting shroud 481 and a lower ducting shroud 482. In the example of FIG. 11, the upper ducting shroud 481 and the lower ducting shroud 482 can be fit together to shroud the fan 200 and the motor 33 and can create air ducts for cooling pump assembly 25 and/or the compressor assembly 20. In an embodiment, the air ducting shroud 485 can also be a motor cover for motor 33. The upper air ducting shroud 481 and the lower air ducting shroud 482 can be connected by a broad variety of means which can include snaps and/or screws.

Figure 12:
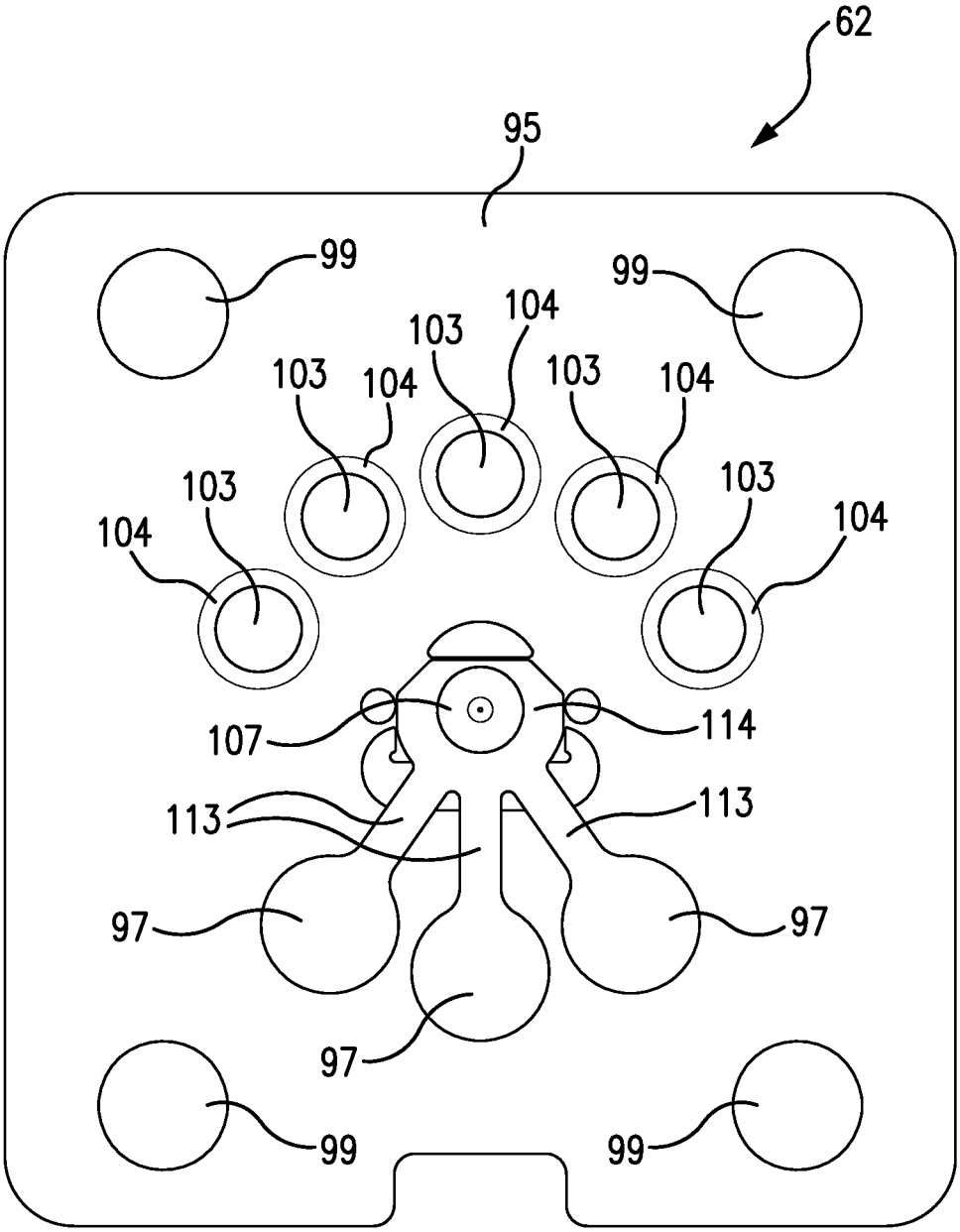
FIG. 12 is a rear view of a valve plate assembly.

FIG. 12 is a rear-side view of a valve plate assembly. A valve plate assembly 62 is shown in detail in FIGS. 12, 13 and 14.

The valve plate assembly 62 of the pump assembly 25 can include air intake and air exhaust valves. The valves can be of a reed, flapper, one-way or other type. A restrictor can be attached to the valve plate adjacent the intake valve. Deflection of the exhaust valve can be restricted by the shape of the cylinder head which can minimize valve impact vibrations and corresponding valve stress.

Figure 13:
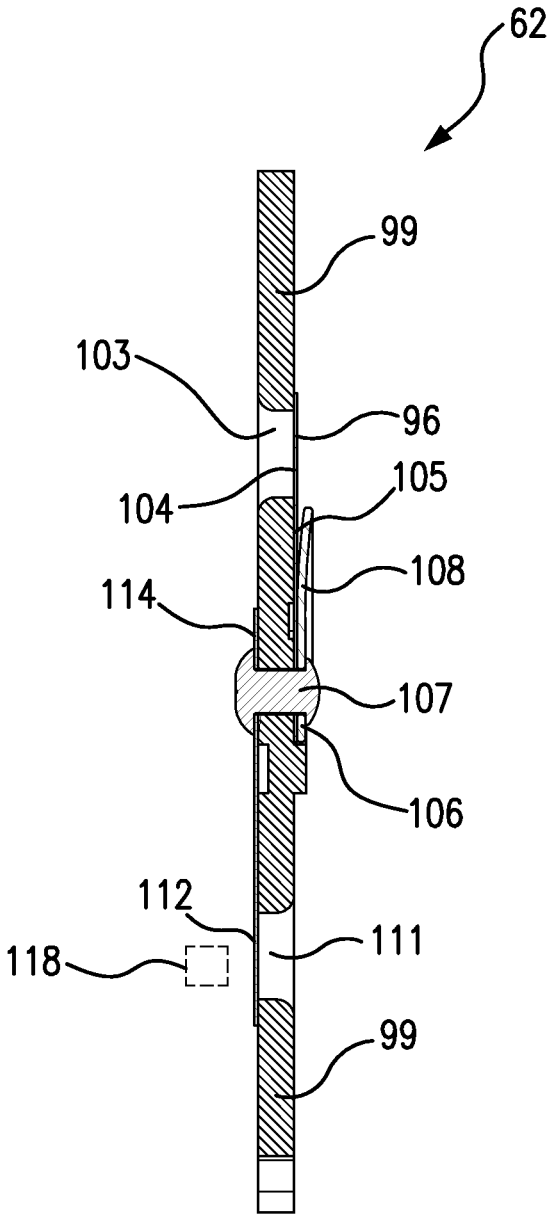
FIG. 13 is a cross-sectional view of the valve plate assembly.
Figure 14:
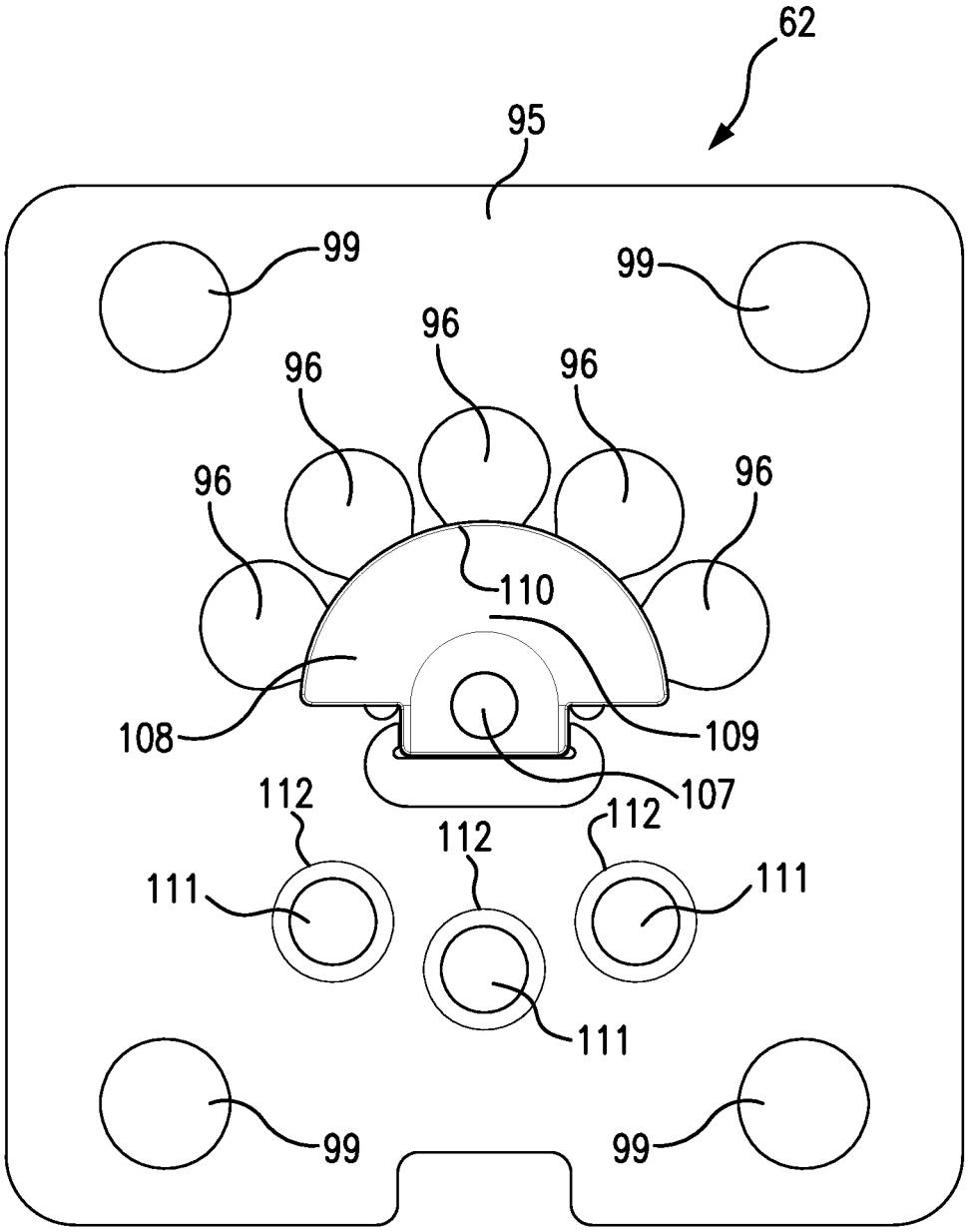
FIG. 14 is a front view of the valve plate assembly.

The valve plate assembly 62 has a plurality of intake ports 103 (five shown) which can be closed by the intake valves 96 (FIG. 14) which can extend from fingers 105 (FIG. 13). In an embodiment, the intake valves 96 can be of the reed or "flapper" type and are formed, for example, from a thin sheet of resilient stainless steel. Radial fingers 113 (FIG. 12) can radiate from a valve finger hub 114 to connect the plurality of valve members 104 of intake valves 96 and to function as return springs. A rivet 107 secures the hub 106 (e.g. FIG. 13) to the center of the valve plate 95. An intake valve restrictor 108 can be clamped between the rivet 107 and the hub 106. The surface 109 terminates at an edge 110 (FIGS. 13 and 14). When air is drawn into the pump cylinder 60 during an intake stroke of the piston 63, the radial fingers 113 can bend and the plurality of valve members 104 separate from the valve plate assembly 62 to allow air to flow through the intake ports 103.

FIG. 13 is a cross-sectional view of the valve plate assembly and FIG. 14 is a front-side view of the valve plate assembly. The valve plate assembly 62 includes a valve plate 95 which can be generally flat and which can mount a plurality of intake valves 96 (FIG. 14) and a plurality of outlet valves 97 (FIG. 12). In an embodiment, the valve plate assembly 62 (FIGS. 10 and 12) can be clamped to a bracket by screws which can pass through the cylinder head 61 (e.g. FIG. 2), the gasket and a plurality of through holes 99 in the valve plate assembly 62 and engage a bracket. A valve member 112 of the outlet valve 97 can cover an exhaust port 111. A cylinder flange and a gas tight seal can be used in closing the cylinder head assembly. In an embodiment, a flange and seal can be on a cylinder side (herein front-side) of a valve plate assembly 62 and a gasket can be between the valve plate assembly 62 and the cylinder head 61.

FIG. 14 illustrates the front side of the valve plate assembly 62 which can have a plurality of exhaust ports 111 (three shown) which are normally closed by the outlet valves 97. A plurality of a separate circular valve member 112 can be connected through radial fingers 113 (FIG. 12) which can be made of a resilient material to a valve finger hub 114. The valve finger hub 114 can be secured to the rear side of the valve plate assembly 62 by the rivet 107. Optionally, the cylinder head 61 can have a head rib 118 (FIG. 13) which can project over and can be spaced a distance from the valve members 112 to restrict movement of the exhaust valve members 112 and to lessen and control valve impact vibrations and corresponding valve stress.

Figure 15A:
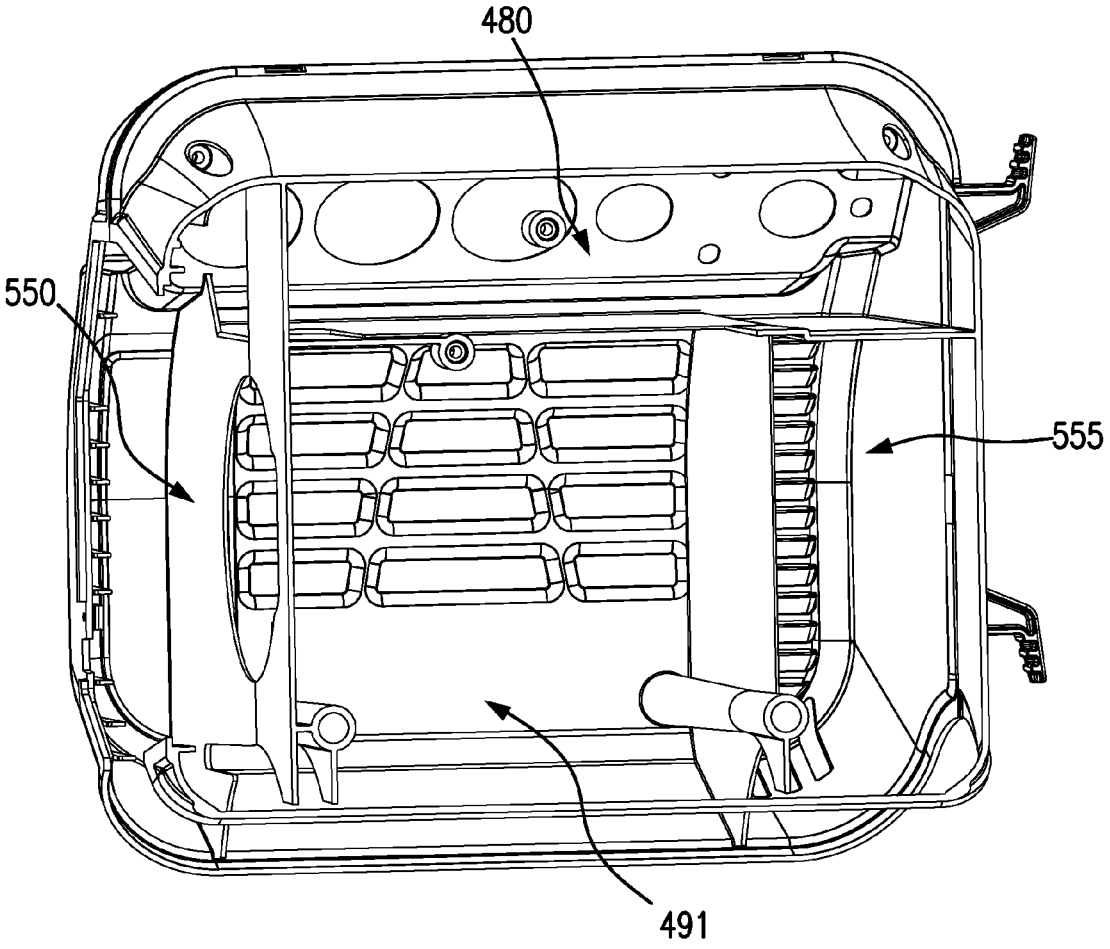
FIG. 15A is a perspective view of sound control chambers of the compressor assembly.

FIG. 15A is a perspective view of a plurality of sound control chambers of an embodiment of the compressor assembly 20. FIG. 15A illustrates an embodiment having four (4) sound control chambers. The number of sound control chambers can vary widely in a range of from one to a large number, e.g. 25, or greater. In a non-limiting example, in an embodiment, a compressor assembly 20 can have a fan sound control chamber 550 (also herein as "fan chamber 550"), a pump sound control chamber 491 (also herein as "pump chamber 491"), an exhaust sound control chamber 555 (also herein as "exhaust chamber 555"), and an upper sound control chamber 480 (also herein as "upper chamber 480").

Figure 15B:
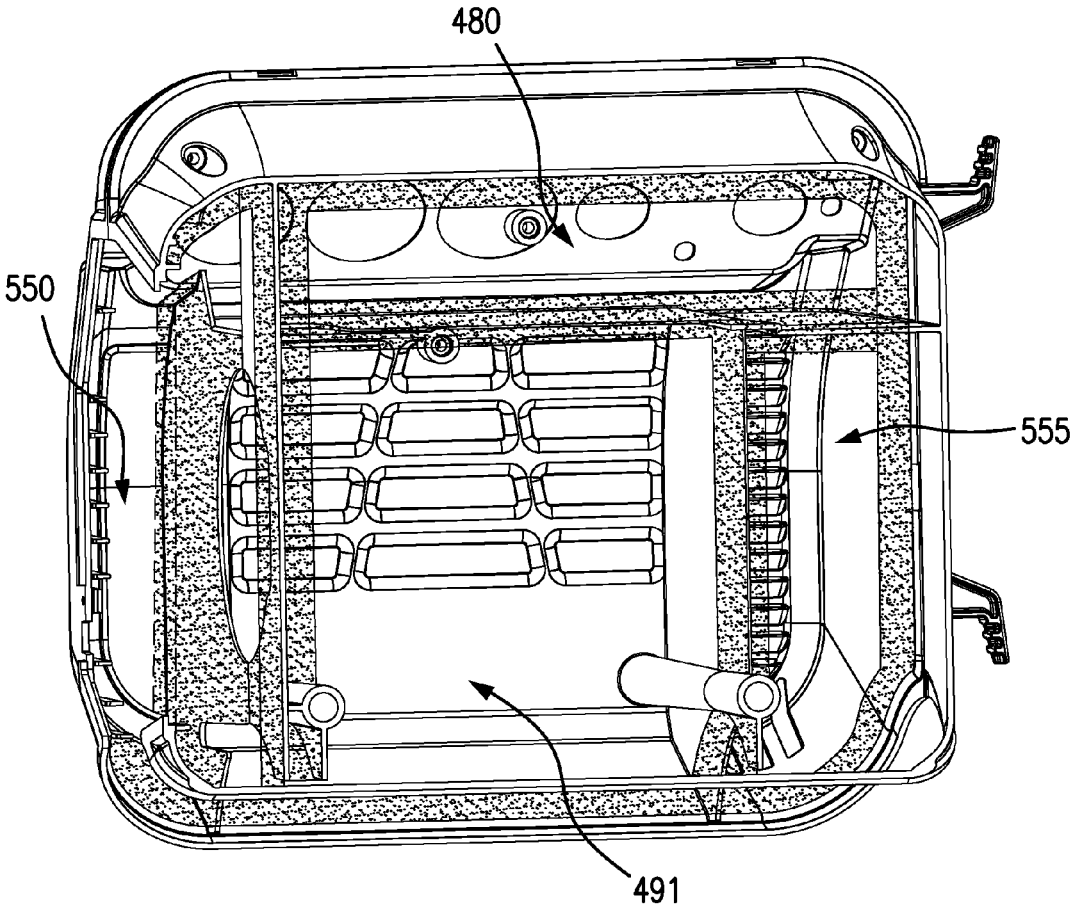
FIG. 15B is a perspective view of sound control chambers having optional sound absorbers.

FIG. 15B is a perspective view of sound control chambers having optional sound absorbers. The optional sound absorbers can be used to line the inner surface of housing 21, as well as both sides of partitions which are within the housing 21 of the compressor assembly 20.

Figure 16A:
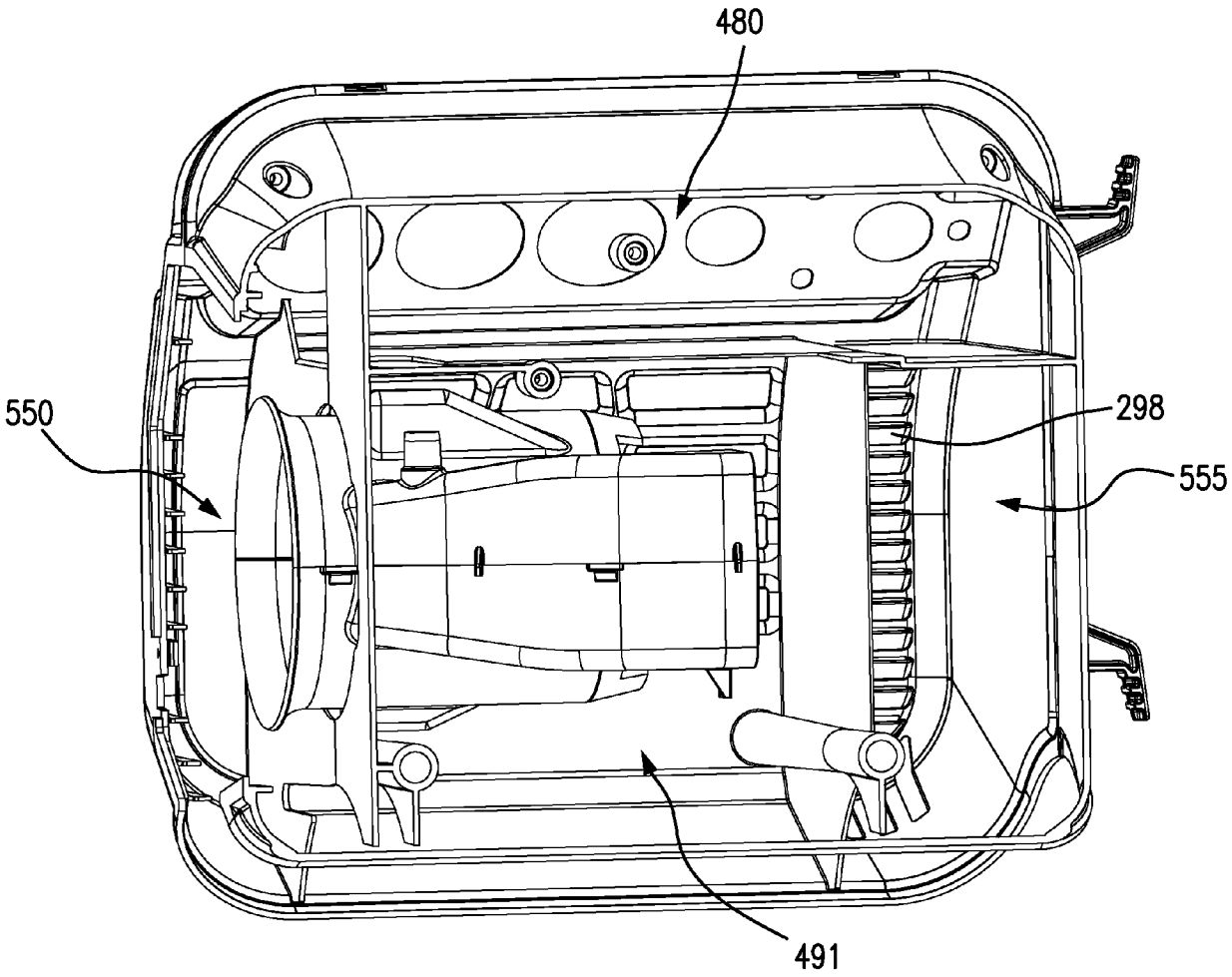
FIG. 16A is a perspective view of sound control chambers with an air ducting shroud.

FIG. 16A is a perspective view of sound control chambers with an air ducting shroud 485. FIG. 16A illustrates the placement of air ducting shroud 485 in coordination with for example the fan chamber 550, the pump sound control chamber 491, the exhaust sound control chamber 555, and the upper sound control chamber 480.

Figure 16B:
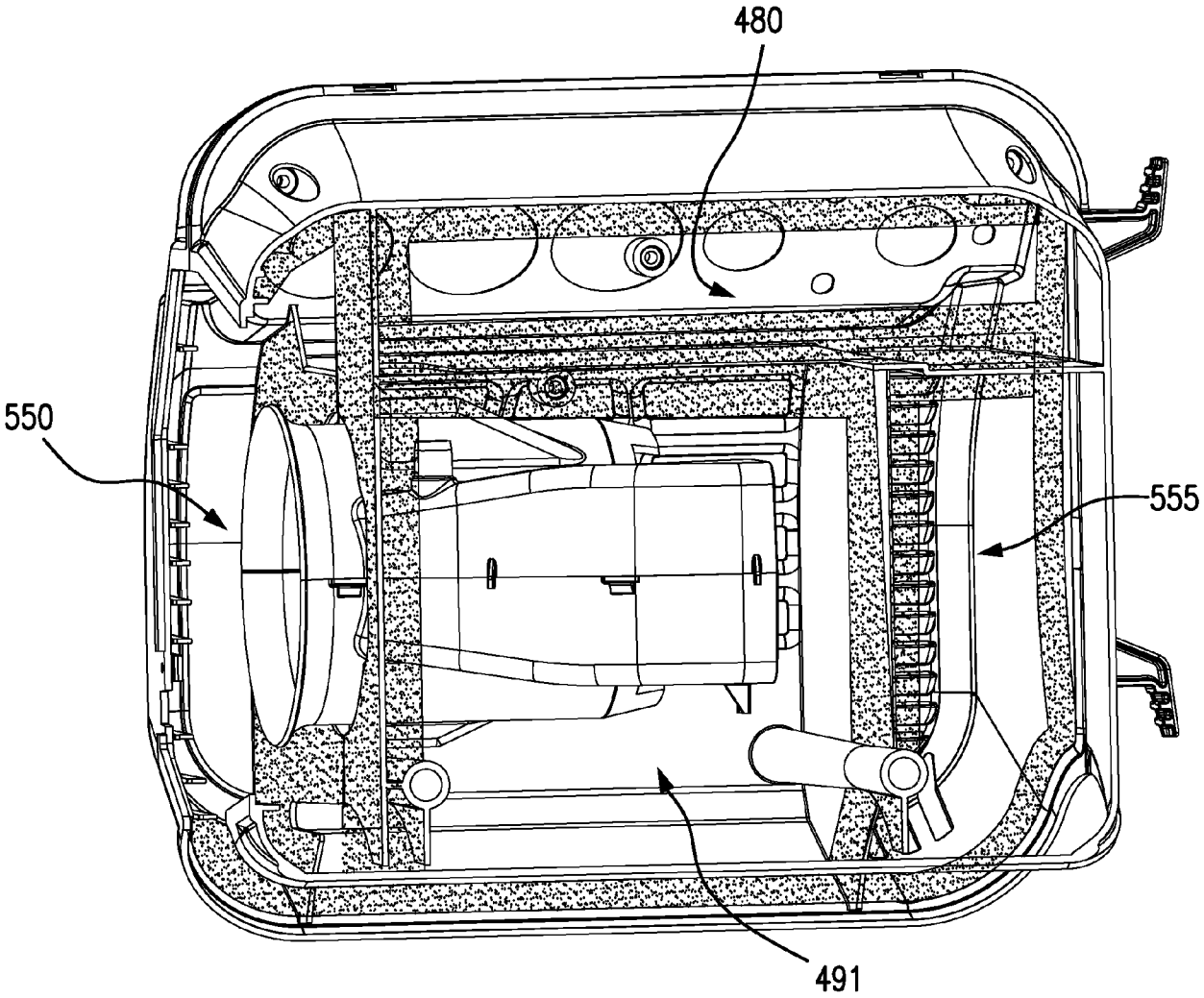
FIG. 16B is a perspective view of sound control chambers having optional sound absorbers.

FIG. 16B is a perspective view of sound control chambers having optional sound absorbers. The optional sound absorbers can be used to line the inner surface of housing 21, as well as both sides of partitions which are within the housing 21 of compressor assembly 20.

FIG. 17 is a first table of embodiments of compressor assembly range of performance characteristics. The compressor assembly 20 can have values of performance characteristics as recited in FIG. 17 which are within the ranges set forth in FIG. 17.

FIG. 18 is a second table of embodiments of ranges of performance characteristics for the compressor assembly 20. The compressor assembly 20 can have values of performance characteristics as recited in FIG. 18 which are within the ranges set forth in FIG. 18.

The compressor assembly 20 achieves efficient heat transfer. The heat transfer rate can have a value in a range of from 25 BTU/min to 1000 BTU/min. The heat transfer rate can have a value in a range of from 90 BTU/min to 500 BTU/min. In an embodiment, the compressor assembly 20 can exhibit a heat transfer rate of 200 BTU/min. The heat transfer rate can have a value in a range of from 50 BTU/min to 150 BTU/min. In an embodiment, the compressor assembly 20 can exhibit a heat transfer rate of 135 BTU/min. In an embodiment, the compressor assembly 20 exhibited a heat transfer rate of 84.1 BTU/min.

The heat transfer rate of a compressor assembly 20 can have a value in a range of 60 BTU/min to 110 BTU/min. In an embodiment of the compressor assembly 20, the heat transfer rate can have a value in a range of 66.2 BTU/min to 110 BTU/min; or 60 BTU/min to 200 BTU/min.

The compressor assembly 20 can have noise emissions reduced by, for example, a slower fan and/or slower motor speeds, use of a check valve muffler, use of tank vibration dampeners, use of tank sound dampeners, use of a tank dampening ring, use of tank vibration absorbers to dampen noise to and/or from the tank walls which can reduce noise. In an embodiment, a two stage intake muffler can be used on the pump. A housing having reduced or minimized openings can reduce noise from the compressor assembly. As disclosed herein, the elimination of line of sight to the fan and other components as attempted to be viewed from outside of the compressor assembly 20 can reduce noise generated by the compressor assembly. Additionally, routing cooling air through ducts, using foam lined paths and/or routing cooling air through tortuous paths can reduce noise generation by the compressor assembly 20.

Additionally, noise can be reduced from the compressor assembly 20 and its sound level lowered by one or more of the following: employing slower motor speeds, using a check valve muffler and/or using a material to provide noise dampening of the housing 21 and its partitions and/or the compressed air tank 150 heads and shell. Other noise dampening features can include one or more of the following and be used with or apart from those listed above: using a two-stage intake muffler in the feed to a feed air port 952, elimination of line of sight to the fan and/or other noise generating parts of the compressor assembly 20, a quiet fan design and/or routing cooling air routed through a tortuous path which can optionally be lined with a sound absorbing material, such as a foam. Optionally, fan 200 can be a fan which is separate from the shaft 43 and can be driven by a power source which is not shaft 43.

In an example, an embodiment of compressor assembly 20 achieved a decibel reduction of 7.5 dBA. In this example, noise output when compared to a pancake compressor assembly was reduced from about 78.5 dBA to about 71 dBA.

Example 1

FIG. 19 is a first table of example performance characteristics for an example embodiment. FIG. 19 contains combinations of performance characteristics exhibited by an embodiment of compressor assembly 20.

Example 2

FIG. 20 is a second table of example performance characteristics for an example embodiment. FIG. 20 contains combinations of further performance characteristics exhibited by an embodiment of compressor assembly 20.

Example 3

FIG. 21 is a table containing a third example of performance characteristics of an example compressor assembly 20. In the Example of FIG. 21, a compressor assembly 20, having an air ducting shroud 485, a dampening ring 700, an intake muffler 900, four sound control chambers, a fan cover, four foam sound absorbers and a tank seal 600 exhibited the performance values set forth in FIG. 21.

The compressor assembly 20, which is driven by an electric motor, can generate heat in the motor windings, as well as in the pump cylinder 60 where the air is compressed. Performance can be enhanced and efficiency gained by dissipating heat produced in the motor 33 and pump cylinder 60. Heat dissipation, can be achieved by forced air cooling. In an embodiment, forced air cooling is achieved by a cooling air flow from the fan 200.

The air ducting shroud 485 can be used to provide a flow of cooling gas, such as air, to the pump assembly 25 which can have a motor 33, a pump 91 (FIG. 9) and the fan 200. The pump assembly 25 can compress a gas such as air. The air ducting shroud 485 can provide ducted air flow which can cool both the pump 91 and motor 33 efficiently. In an embodiment, the air ducting shroud 485 can be used to form one duct or a plurality of ducts which can direct cooling air from the fan 200 to one or a plurality of components of the pump assembly 25, such at to the pump 91 and motor 33.

In an embodiment, the motor 33 can be positioned to place the motor field windings, such as upper stator coil 40 and lower stator coil 41, at an orientation orthogonal to the cylinder head 61 (FIG. 27) to not substantially interfere with, or cause undesired choking, or compete for, cooling air flow to the cylinder head 61. The orientation of the field windings eliminates the need for these components to compete for the same cooling air. An orientation in which the motor field windings and/or motor do not substantially interfere with, or cause undesired choking of, or fight for, cooling air flow to the cylinder head 61 achieves efficient heat transfer and cooling air flow to portions of the pump assembly 25, such as the motor 33 and the cylinder head 61. Orienting the motor to allow an increased air flow to the head increases heat transfer and cooling to the cylinder head 61 and/or pump cylinder 60 and/or pump 91.

Figure 27:
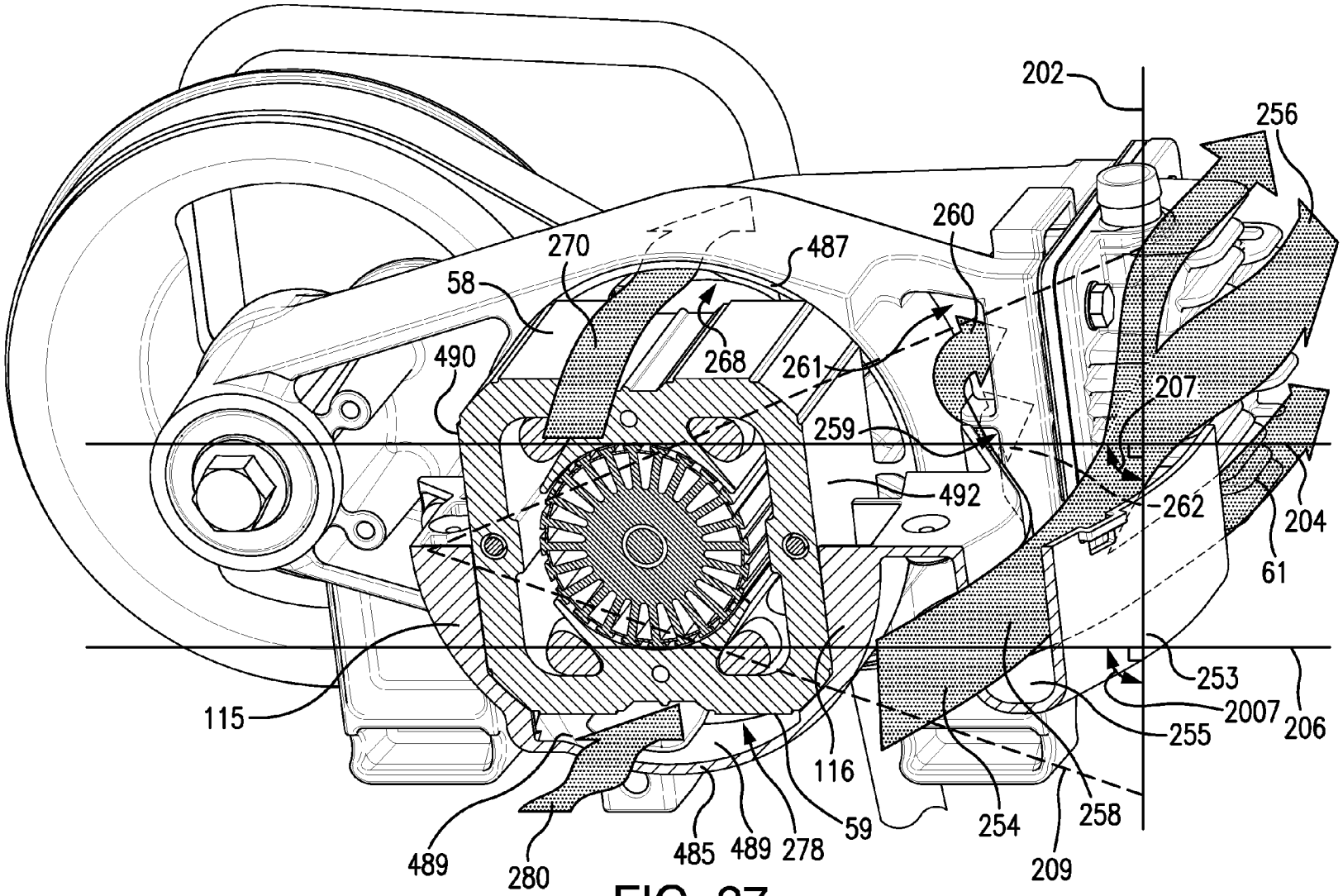
FIG. 27 is a cutaway sectional view of the air ducting shroud and cooling air plow paths.

In an embodiment, the above-mentioned advantages can be achieved by arranging the motor field windings, such as the upper stator coil 40 and the lower stator coil 41, so they are offset from and/or not lined up with the cylinder head 61 (FIG. 27). Offsetting of the motor field windings from the cylinder head 61 can at least in part eliminate blocking or choking of the cylinder head 61 from cooling air flow. Such offsetting can allow ample cooling air flow to the motor field windings and the pump 91 concurrently. In this arrangement, both the pump and motor can be cooled by cooling air flow from a single fan 200. Additionally, this configuration allows for the use of a single fan having a low rate of flow to cool both of the pump 91 and the motor 33, and/or optionally the pump assembly 25. In an embodiment, the pump assembly 25 can be cooled by a single fan 200.

When mounting an air compressor in a housing, adequate cooling can affect the operating life of a compressor assembly 20 and the motor 33. Sources of heat in the motor 33 include but are not limited to the commutator 51 (FIG. 3), the first stator coil 40, the second stator coil 41, and coils in the rotor 50 (FIG. 3). Heat can be produced by the air as it is compressed in pump 91 and by the drive belt 65 (FIG. 3). The fan blade 205 can establish a forced flow of cooling air through the housing 21. According to one feature of the invention, the air ducting shroud 485 can separate the cooling air into a number of streams to cool these components of the compressor assembly 20.

In an embodiment, housing 21 can encase an air ducting shroud 485 (FIG. 2) which can have a number of pathways for guiding the cooling air from the fan 200. In a non-limiting example, the compressor assembly 20 cooling air stream 2000 is drawn into the fan 200 through the plurality of intake slots 182, and is driven into the compressor assembly as fan effluent stream 193 by the plurality of fan blades 205.

In an embodiment, the compressor assembly 20 uses pathways to direct the flow of cooling air to locations, such as for example to cool the pump 91 and the motor 33.

Cooling the pump 91 and the motor 33 allows each to operate with improved efficiency. A pump cooling path for the pump assembly 25 can be created by forming an internal cast opening in the air ducting shroud 485.

In an embodiment, the cooling air flow can be divided into a number of cooling air flows (also herein as "segments"). In an embodiment, the flow paths can be of a size which reduces back pressure and avoids choking cooling air flow.

In an embodiment, the fan effluent stream 193 cooling air flow can be divided into two cooling air flows, a first cooling air flow (also herein as "segment 1") and a second cooling air flow (also herein as "segment 2"). In the two cooling air flow embodiment, one of the cooling air flows can flow across the bottom field winding and the other cooling air flow can flow across the top field winding and the cylinder head 61 area of pump 91.

Figure 22:
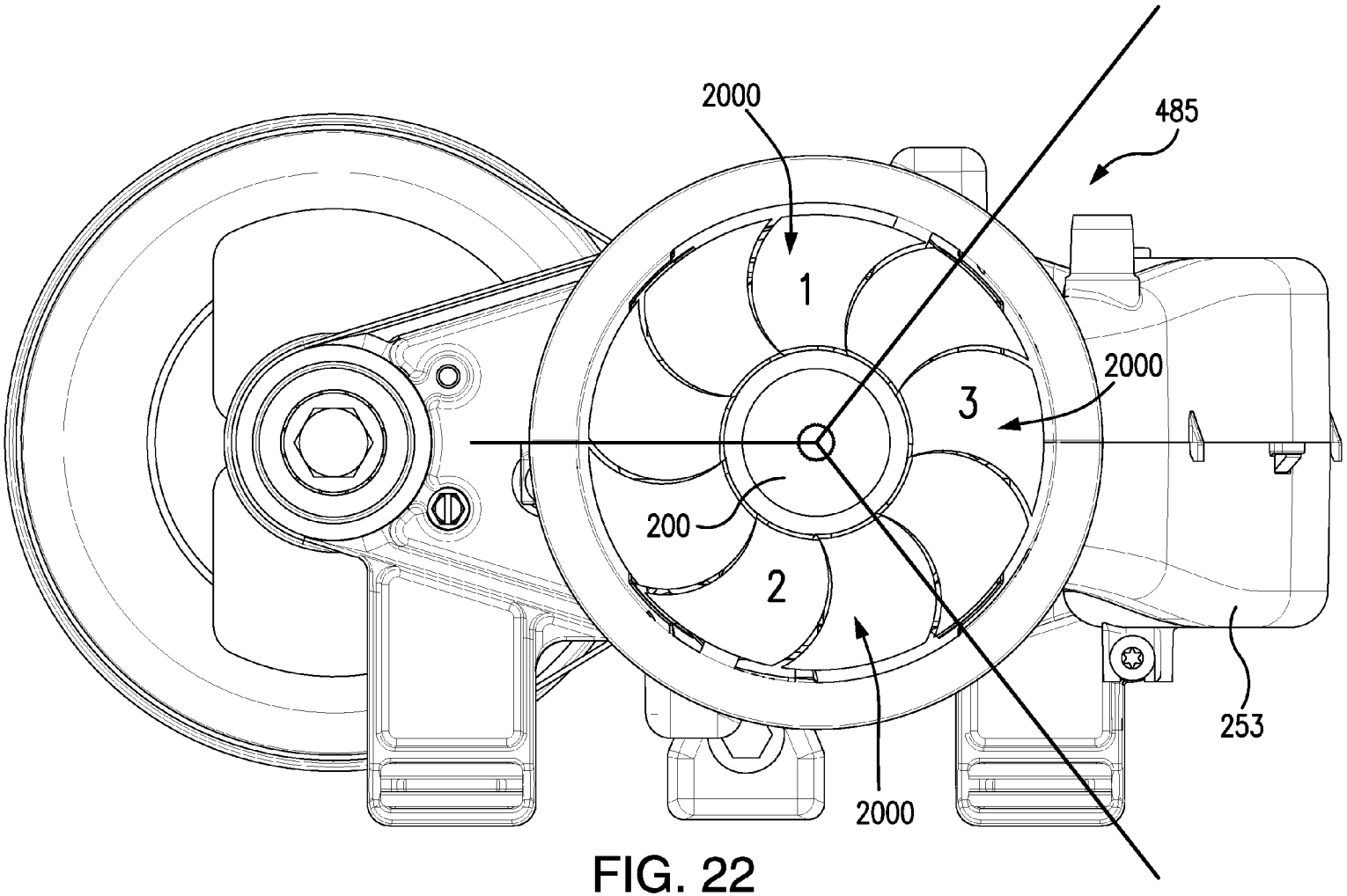
FIG. 22 is a view of the intake-side of the fan.

FIG. 22 is another embodiment in which the cooling air flow can be divided into three cooling air flows (three cooling air segments).

The example of FIG. 22 illustrates a fan 200 which can feed ambient air as cooling air into the air ducting shroud 485. The cooling air flow can be divided into at least three (3) cooling air flows. In an embodiment, the cooling air flow can be divided into a first cooling air flow (also herein as "segment 1"), a second cooling air flow (also herein as "segment 2") and a third cooling air flow (also herein as "segment 3"). Respectively, FIG. 22 designates these cooling air flows representatively as "1", "2" and "3".

Figure 23:
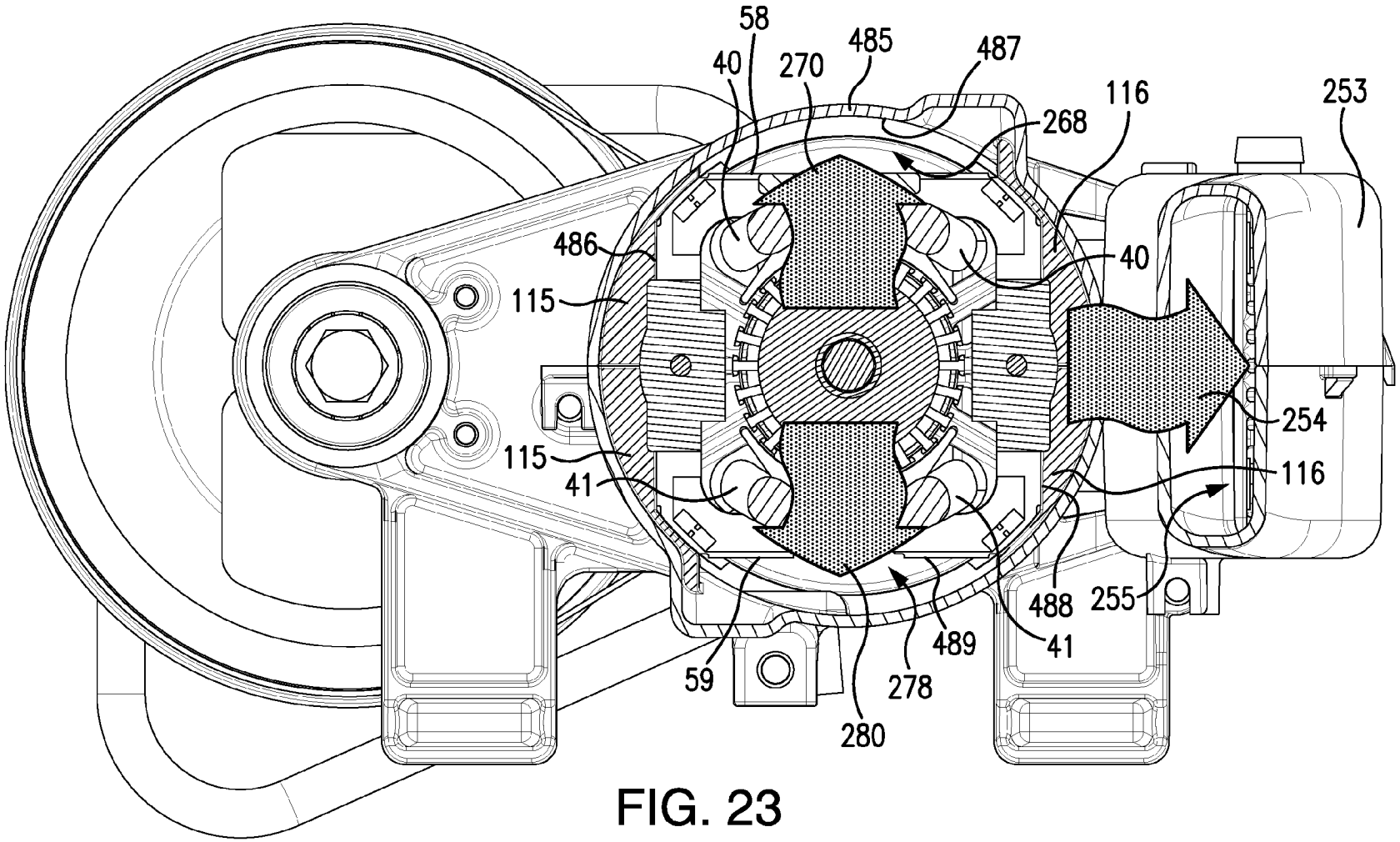
FIG. 23 is a first sectional view of the pump assembly.

As illustrated in FIG. 22, the cooling air stream 2000 which passes through the fan 200 becomes the fan effluent stream 193 (FIG. 3) which can be separated internally into a plurality of cooling air flows, e.g. three or more cooling air flows stream. In FIG. 22, the fan effluent stream 193 can be partitioned into at least three streams as shown by the partition lines and three stream partition designations, i.e. "1", "2" and "3". In an embodiment, a cooling air flow 1 ("segment 1" of FIG. 22) can at least in part feed an upper motor stream 270 (FIG. 23). A cooling air flow 2 ("segment 2" of FIG. 22) can at least in part feed a lower motor stream 280 (FIG. 27). A cooling air flow 3 ("segment 3" of FIG. 22) can at least in part feed a pump stream 254 (FIG. 23).

The partition lines shown in FIG. 22 are exemplary in nature and the actual flow division of the fan caused by the air ducting shroud 485 will occur in accordance with the mechanical design of the air ducting shroud 485 and the fluid dynamics of the flow streams and the open paths which can exist.

In the embodiment disclosed herein, the cooling design of the compressor assembly 20 can control a temperature rise of the motor that meets or exceeds that required by UL 1450 (which is a standard set by UL LLC, 333 Pfingsten Road Northbrook, Ill. 60062-2096).

FIG. 23 is a first sectional view of the pump assembly showing the upper motor stream 270 cooling the fan-side of the upper stator coil 40. The lower motor stream 280 is also illustrated cooling the fan-side of the lower stator coil 41.

Electricity flowing through the field windings of the motor 33 generates heat in the motor. The air ducting shroud 485 can direct the cooling air into the areas heated by the heat generated in the motor 33. The sides of the motor that do not contain field windings can be blocked off (fully or partially depending on need) to force more air across the other two sides of the motor where the field windings are located, as well as into conduit 253. In this example, fan effluent stream 193 is split into three cooling air flow paths and each flow path is directed to one of at least three areas that need cooling, such as the two sides of the motor having stator coils (upper stator coil 40 and lower stator coil 41) and the pump 91 area having cylinder head 61 and pump cylinder 60. In an embodiment, the stream which can cool the cylinder head 61 can also cool the pump cylinder 60.

In an embodiment, the upper motor stream 270 can flow across at least a portion of the upper stator coil 40; the lower motor stream 280 can flow across at least a portion of the lower stator coil 41; and a conduit air stream 254 can flow across the cylinder head 61 and the pump cylinder 60 of the pump 91.

FIG. 27 illustrates the upper coil centerline 204 intersecting head centerline 202 at angle 207 which is 90 degrees. The lower coil centerline 206 is illustrated to intersect head centerline 202 at angle 207 which is 90 degrees. For illustrative purposes, this configuration can form the triangle 209 among at least a portion of the respective motor coils and head centerline 202 as shown in FIG. 27. Such configuration allows for easy passage of cooling air and separation of the cooling air blown by the fan.

FIG. 23 illustrates an embodiment having the fan effluent stream 193 which is separated into a upper motor stream 270, a lower motor stream 280 and a conduit air stream 254. The upper motor stream 270 can flow through the upper motor path 268 to cool the upper stator coil 40. The lower motor stream 280 can flow through lower motor path 278 to cool the lower stator coil 41. The conduit air stream 254 can flow through the conduit 253 to cool the cylinder head 61 and the pump cylinder 60.

FIG. 23 illustrates a front blocking partition 115 which blocks air flow along the front motor surface 486 of the motor 33. FIG. 23 also illustrates a rear blocking partition 116 which blocks air flow along the rear motor surface 488 of the motor 33. The blocking partition 115 and the blocking partition 116 can provide resistance which can force the cooling air to pass through the upper motor path 268 and the lower motor path 278, as well as through conduit 253 having conduit flow path 255.

In the example embodiment of FIG. 23, upper motor path 268 can be a passageway formed from surfaces of the motor 33 and the air ducting shroud 485. For example, upper motor path 268 can have a portion of the upper motor block surface 58 and a portion of the upper inside surface 487 of the air ducting shroud 485 (also herein as "motor cover 485"). In this example, the lower motor path 278 can be a passageway formed from e.g. a portion of the lower motor block surface 59 and a portion of the lower inside surface 489 of air ducting shroud 485.

In this embodiment, the air ducting shroud 485 can form the conduit 253 having the conduit flow path 255 and can have at least a portion which flows through the conduit 253.

Figure 24:
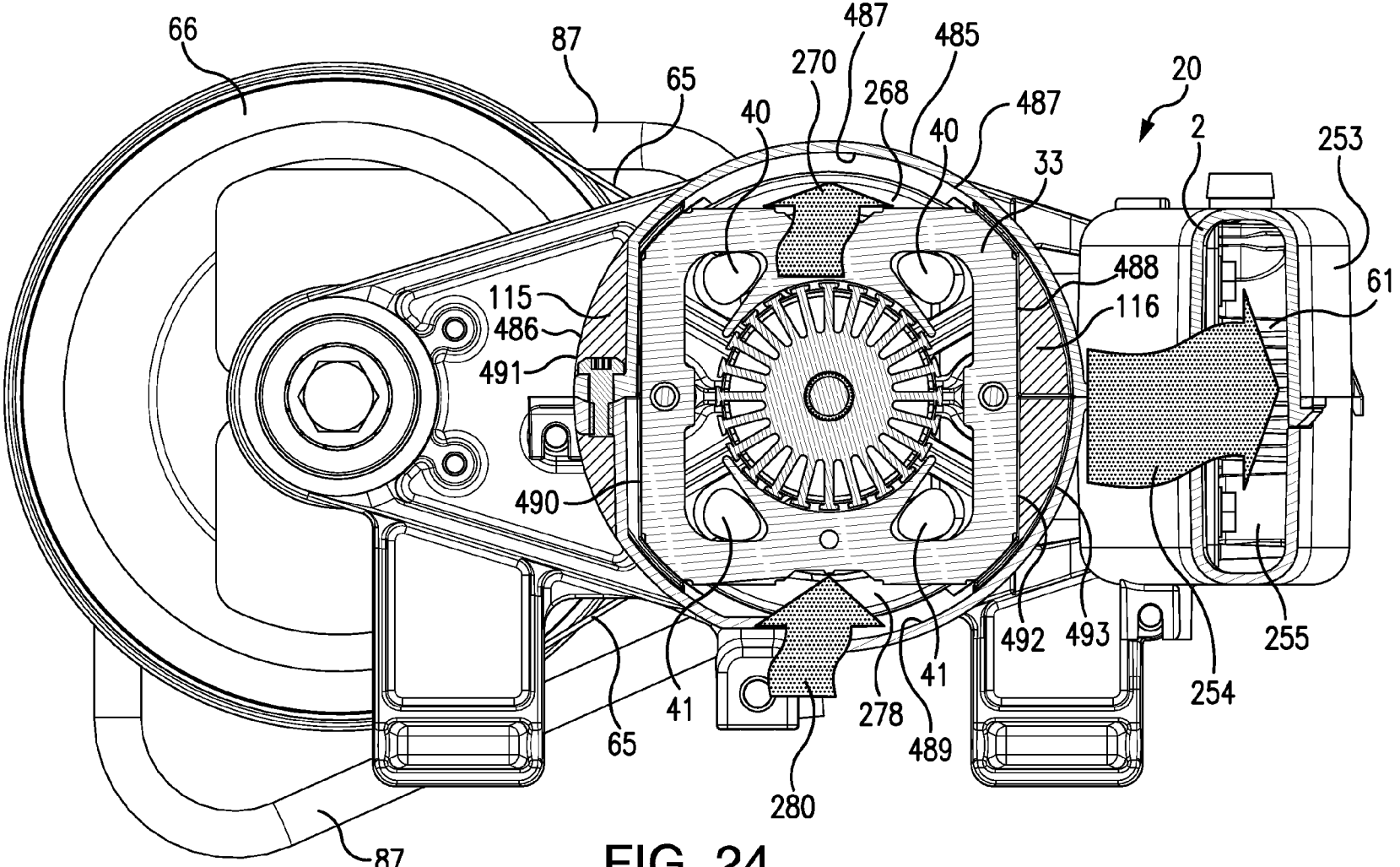
FIG. 24 is a second sectional view of the pump assembly.

FIG. 24 is a sectional view of a perspective of the fan-side of the motor in which the upper motor stream 270 can flow through the upper motor path 268, the lower motor stream 280 can flow through the lower motor path 278 and the conduit air stream 254 can flow the through the conduit 253.

FIG. 24 also is a cross-sectional view of the motor 33 and the conduit 253. In the example of FIG. 24, the blocking partitions 115 and the blocking partition 116 can force the cooling air to pass through the upper motor path 268, the lower motor path 278 and the conduit 253. In the embodiment illustrated in FIG. 24, the front blocking partition 115 and the rear blocking partition 116 are illustrated as blocking the flow of air along the front motor surface 490 and rear motor surface 492. The front blocking partition 115 can block the formation of an air flow between the front motor surface 490 and the front inside surface 486 of the air ducting shroud 485. The rear blocking partition 116 can block the formation of air flow between the rear motor surface 492 and the rear inside surface 488 of air ducting shroud 485. When the front blocking partition 115 and the rear blocking partition 116 are used, the fan effluent stream 193 can be partitioned to the cool the motor 33 (FIG. 3) and provide flow at least through upper motor path 268, the lower motor path 278 and the conduit flow path 255.

Figure 25:
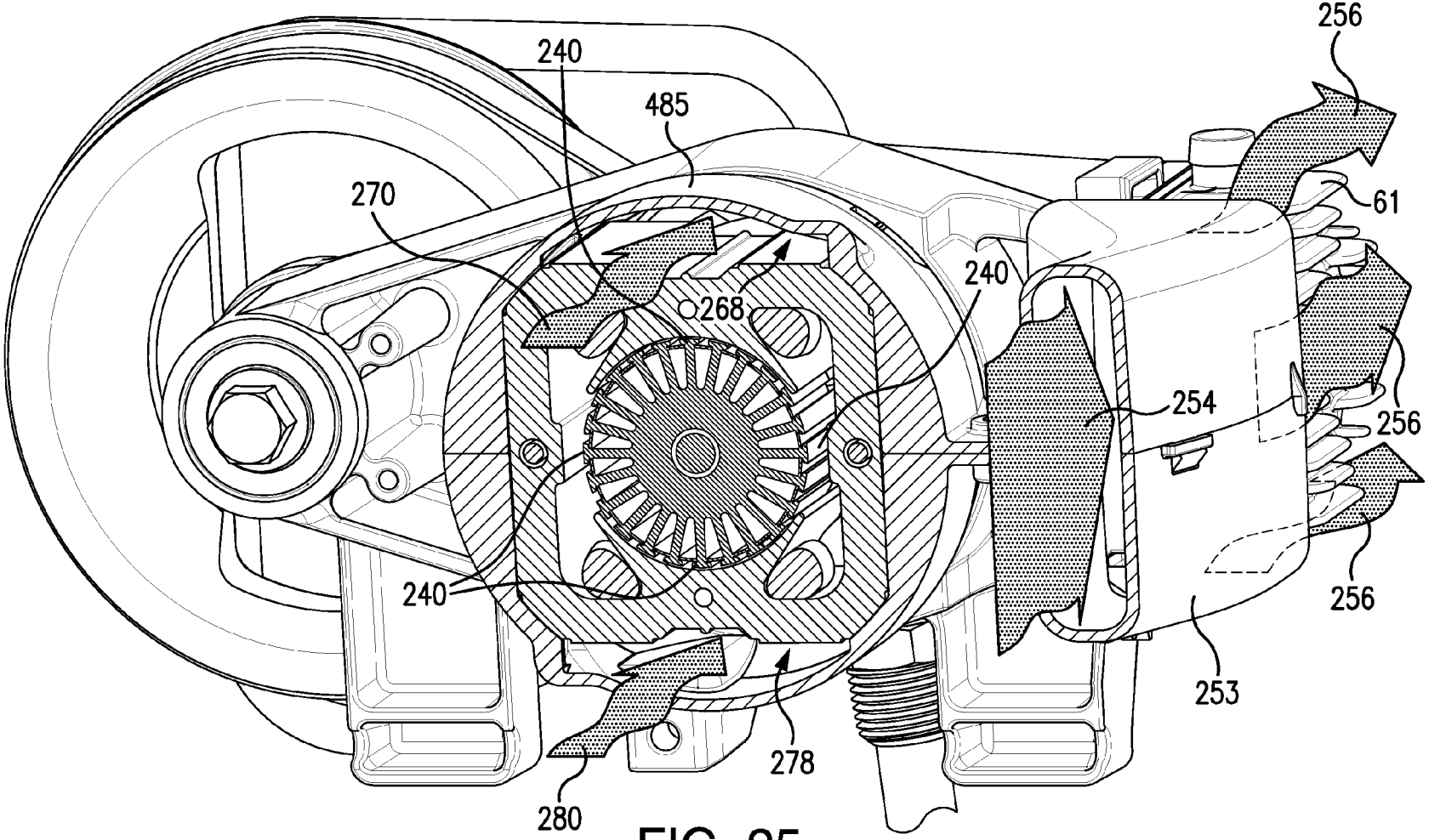
FIG. 25 is a sectional view of the pump assembly.

FIG. 25 is a sectional view of the pump assembly 25. The upper motor stream 270 can flow through the upper motor path 268. The lower motor stream 280 can flow through lower motor path 278. The conduit air stream 254 can flow through conduit 253 of air ducting shroud 485. In the example of FIG. 25, the flow of the conduit air stream 254 over cylinder head 61 can become a head air stream 256 as it contacts and flows across the cylinder head 61.

Optionally, the conduit 253 can extend to cover at least a portion of cylinder head 61. Optionally, the conduit 253 can be formed to provide cooling to at least a portion of the pump 91, such as the pump cylinder 60 and/or the cylinder head 61.

Figure 26:
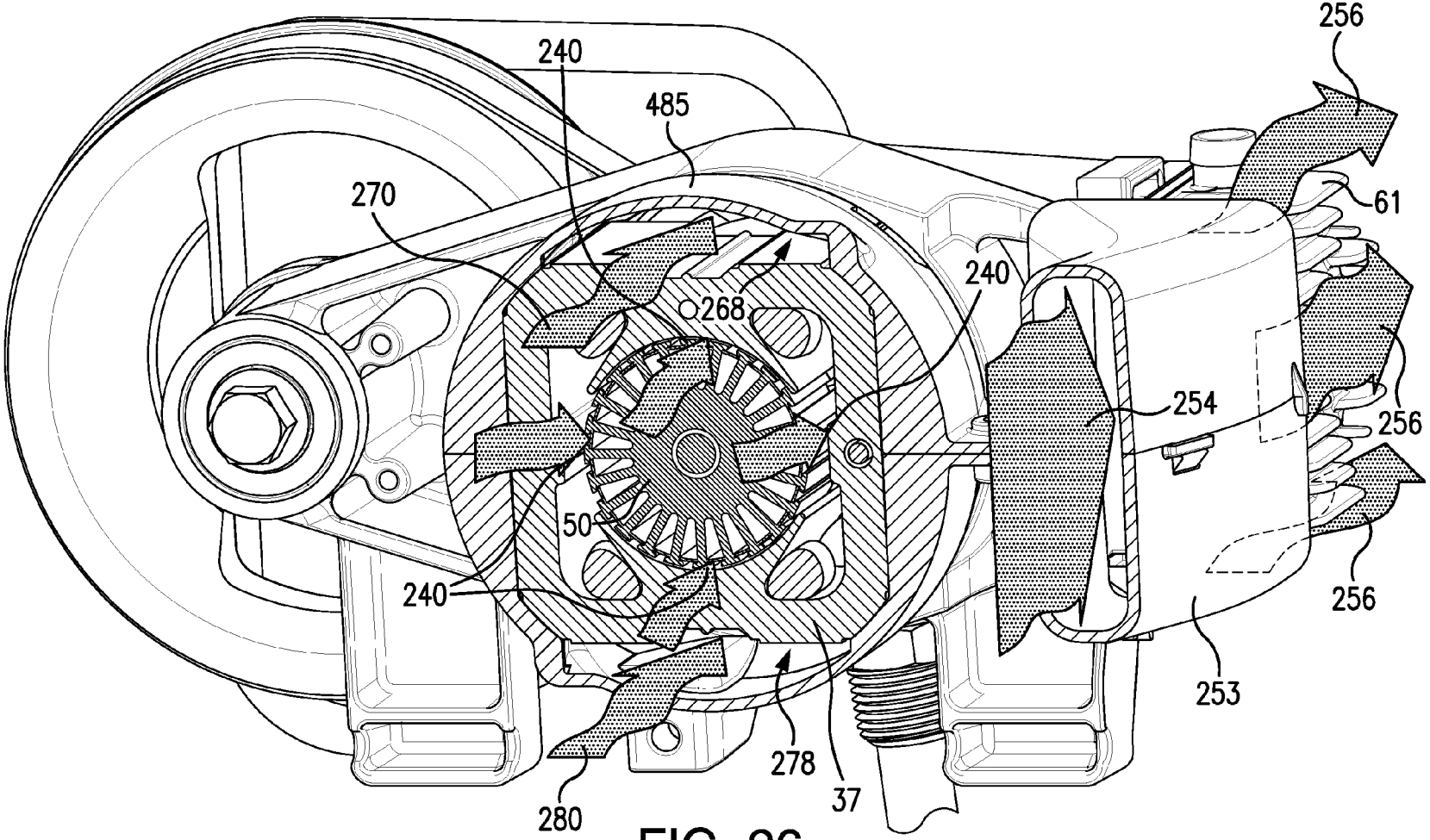
FIG. 26 is a sectional view of the motor and cooling air flow paths.

As shown in FIG. 26, an upper motor path 268 is formed between the upper stator portion of the motor and the inner diameter of the air ducting shroud 485 and a lower motor path 278 is formed between the lower stator portion of the motor and the inner diameter of the air ducting shroud 485. A motor gap 240 can extend in an axial direction through the motor 33 between the stator and the rotor. A portion of the air delivered by the fan blade 205 can flow though the motor air gap 240. In an embodiment, the cooling air can flow along a path in example sequence over the commutator 51 and brush assembly, then through the motor air gap 240, then over at least a portion of the pump cylinder 60 and through the plurality of exhaust slots 31. In an embodiment, this first flow of air can accept heat transfer from at least the motor 33, and then optionally at least the pump cylinder 60 and the cylinder head 61.

FIG. 26 is a sectional view of the motor and cooling air flow paths; showing cooling air which can flow through motor air gap 240 and flow across the upper stator coil 40 and the lower stator coil 41. The fan can direct some air to travel through the motor air gap 240 between the armature and the electric field to help cool the armature windings.

FIG. 27 is a cutaway sectional view of the air ducting shroud and cooling air flow.

Figure 28:
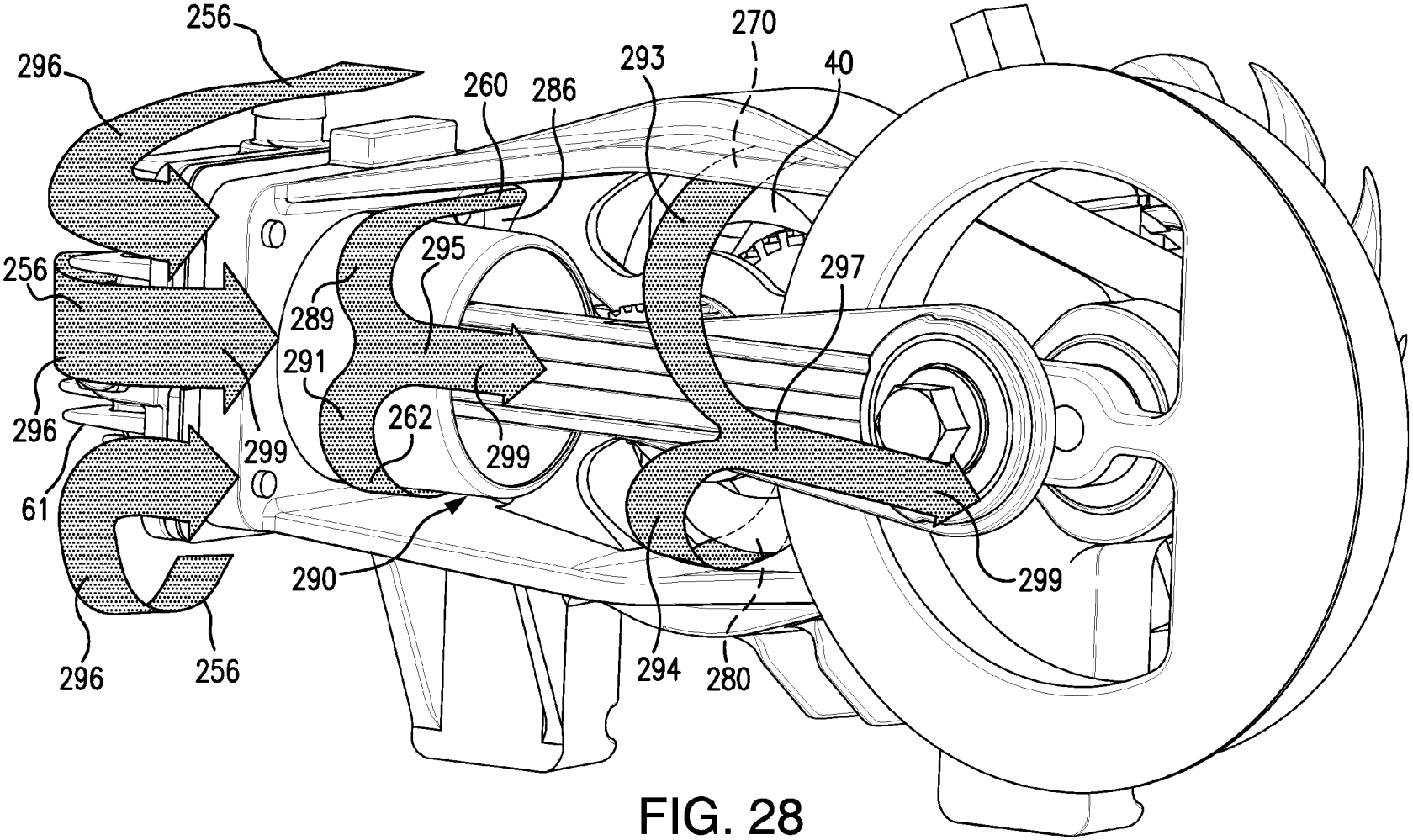
FIG. 28 illustrates exhaust plow paths.

As shown in FIG. 27, the upper motor stream 270 can flow through the upper motor path 268. The lower motor stream 280 can flow through lower motor path 278. FIG. 27 also illustrates a conduit air stream 254 which flows through conduit 253. A portion of the conduit air stream 254 can feed the pump stream 258 which separates from conduit stream 254 to cool the pump cylinder 60 of the pump 91. FIG. 28 also illustrates that the portion of the conduit air stream which does not become the pump stream 258 becomes the head air stream 256 which flows to cool cylinder head 61.

FIG. 27 also illustrates that the cylinder air stream 258 can separate from the pump air stream 254 into a first cylinder air stream 260 and a second cylinder air stream 262 to cool pump cylinder 60. The pump stream 258 can optionally be split as it passes though a plurality of optional ports. In the example of FIG. 27 pump stream 258 can split into a first cylinder air stream 260 which can flow through a first cylinder cooling port 261 and a second cylinder air stream 262 can flow through a second cylinder cooling port 259. The first cylinder air stream 260 and the second cylinder air stream 262 can cool at least pump cylinder 60.

In an embodiment, the fan effluent stream 193 can also supply flow to an upper motor stream 270 through upper motor path 268 and a lower motor stream 280 through lower motor path 278.

In an embodiment, the motor can be cooled at least in part by an upper motor stream 270 which can flow through an upper motor path 268. Additionally, the motor can be cooled at least in part by a lower motor stream 280 which can flow through lower motor path 278.

In an embodiment, at least a portion of the head air stream 256 flows over the cylinder head 61. Additionally, at least a portion of the pump cooling path can guide a portion the cooling air over the cylinder head 61 and pump cylinder 60. Also, a first cylinder air stream 258 can flow over at least a portion of pump cylinder 60 and can feed at least a portion of second cylinder air stream 262 which can also feed at least a portion of a second cylinder air stream 260 which can flow over at least a portion of pump cylinder 60.

FIG. 28 illustrates the exhaust flow paths. FIG. 28 is a pump-side view which illustrates the exhaust flow from the head air stream 256 as cylinder head exhaust air stream 296. The head exhaust air stream 296 can become an exhaust air stream 299.

FIG. 28 illustrates that the first cylinder air stream 260 (FIG. 28) can become a first cylinder exhaust air stream 289 which can become a cylinder exhaust air stream 295. The second cylinder air stream 262 (FIG. 28) can become a second cylinder exhaust air stream 291 which can become a cylinder exhaust air stream 295. The cylinder head exhaust air stream 295 can also become an exhaust air stream 299.

In the example embodiment illustrated in FIG. 28, the upper motor stream 270 can flow through the upper motor path 268, then across upper stator coil 40 and becomes upper winding exhaust 293. The lower motor stream 280 can flow through the lower motor path 278, then across lower stator coil 41 and becomes lower winding exhaust 294.

The upper motor stream 270 can become an upper winding exhaust air stream 293 which can become a windings exhaust air stream 297. The lower motor stream 280 can become a lower winding exhaust air stream 294 which can become a windings exhaust air stream 297. The windings exhaust air stream 297 can become an exhaust air stream 299.

FIG. 28 illustrates the flow of the exhaust air stream 299. In an embodiment, the exhaust air stream 299 is a combined exhaust air stream of the exhausts streams which have passed over portions of the motor or portions of the pump. In an embodiment, the exhaust air stream 299 is a combined exhaust air stream of the exhaust flowing from upper motor path 268, lower motor path 278 and conduit 253.

Figure 29:
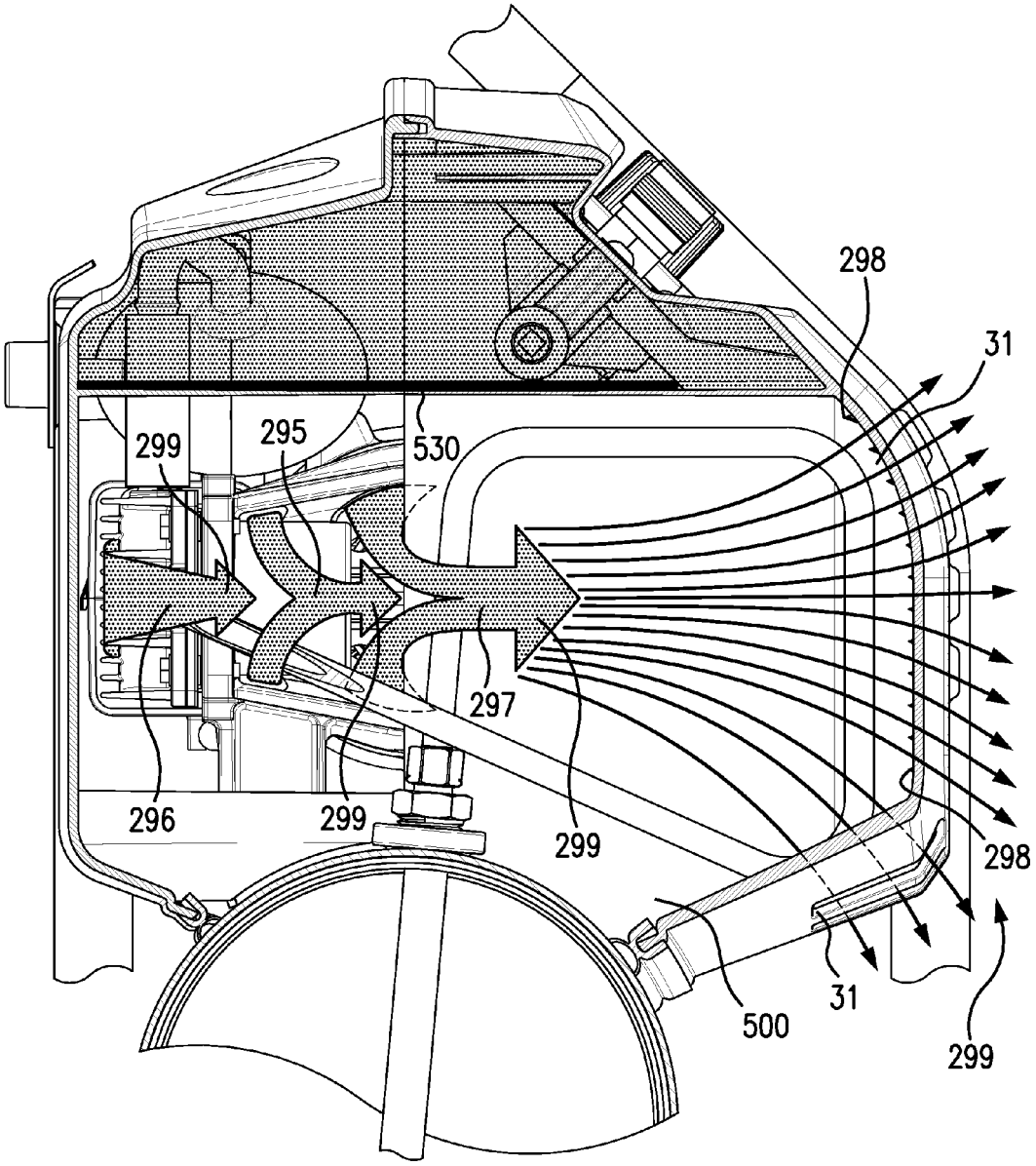
FIG. 29 is a view of exhaust venting.

FIG. 29 illustrates a view of exhaust venting. FIG. 29 illustrates the head exhaust air stream 296 becoming an exhaust air stream 299 and exiting the compressor assembly 20 through a plurality of the exhaust air slots 31. The cylinder exhaust air 295 can become an exhaust air stream 299 and can exit the compressor assembly 20 through the exhaust air slots 31. The windings exhaust air stream 297 can become an exhaust air stream 299 and can exit the compressor assembly 20 through the exhaust air slots 31. Optionally, one or a plurality of louvers 298 can be used in conjunction with the exhaust air slots 31. The louvers 298 can eliminate an operator's line-of-sight to the pump assembly 25 and/or to one or more noise making parts.

Figure 30:
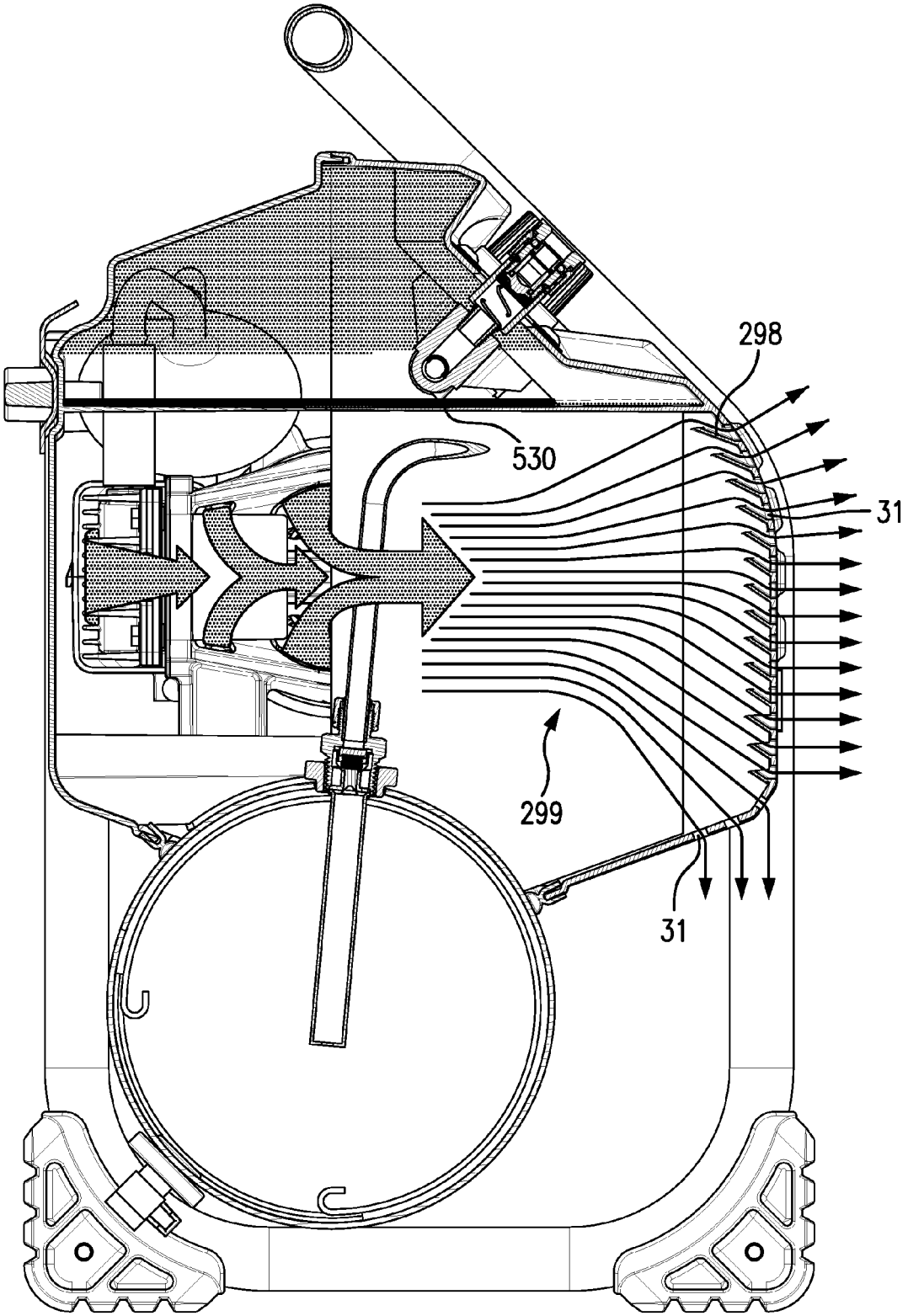
FIG. 30 is a cross-sectional view of an exhaust chamber of the compressor assembly.

FIG. 30 is a cross-sectional view of the exhaust chamber of the compressor assembly. In the embodiment of FIG. 30, a plurality of louvers 298 can be used in conjunction with the exhaust air slots 31.

Figure 31:
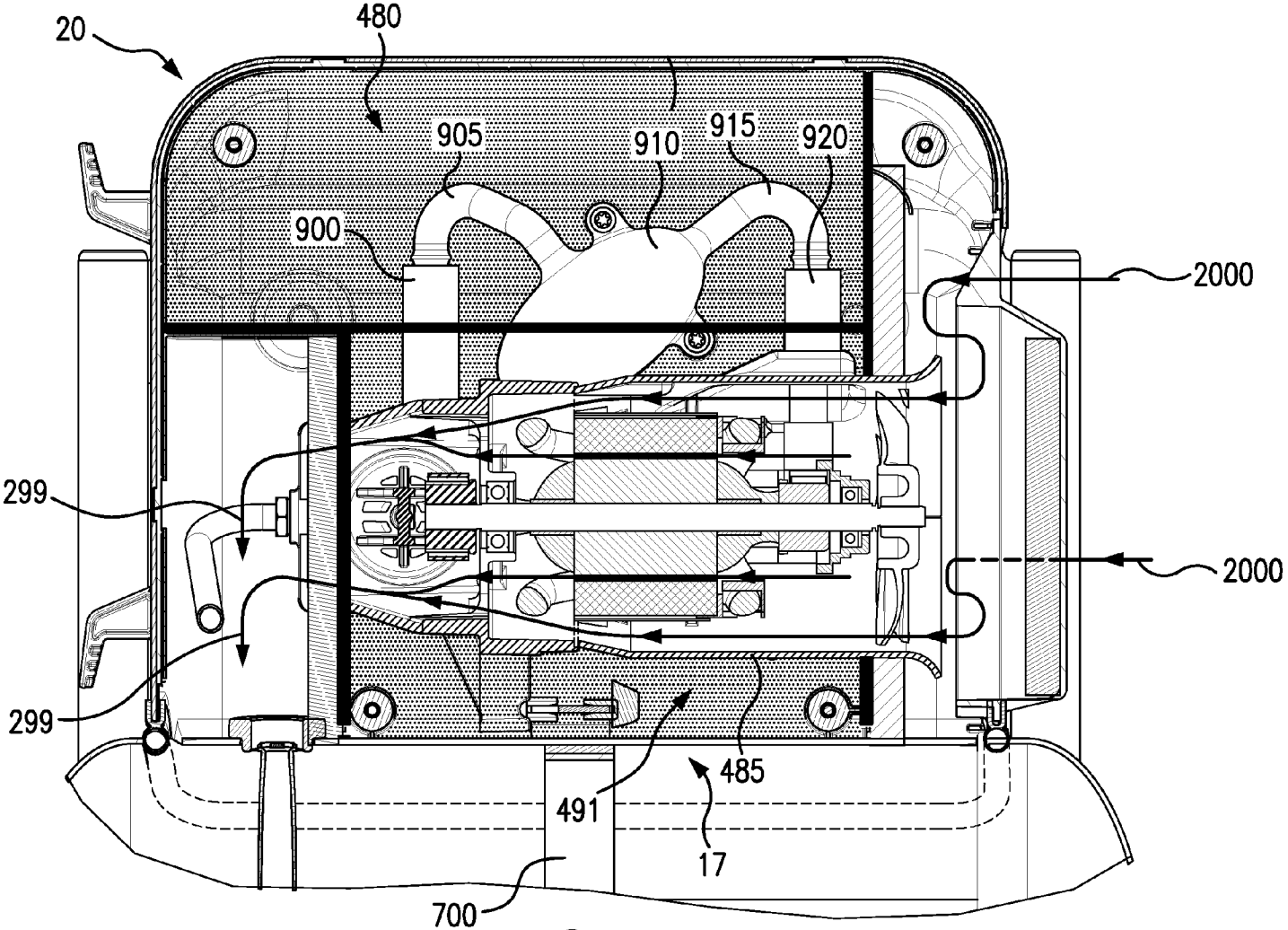
FIG. 31 is a front sectional view showing examples of cooling air plow paths.

FIG. 31 is a front sectional view showing examples of cooling air plow paths.

Figure 32:
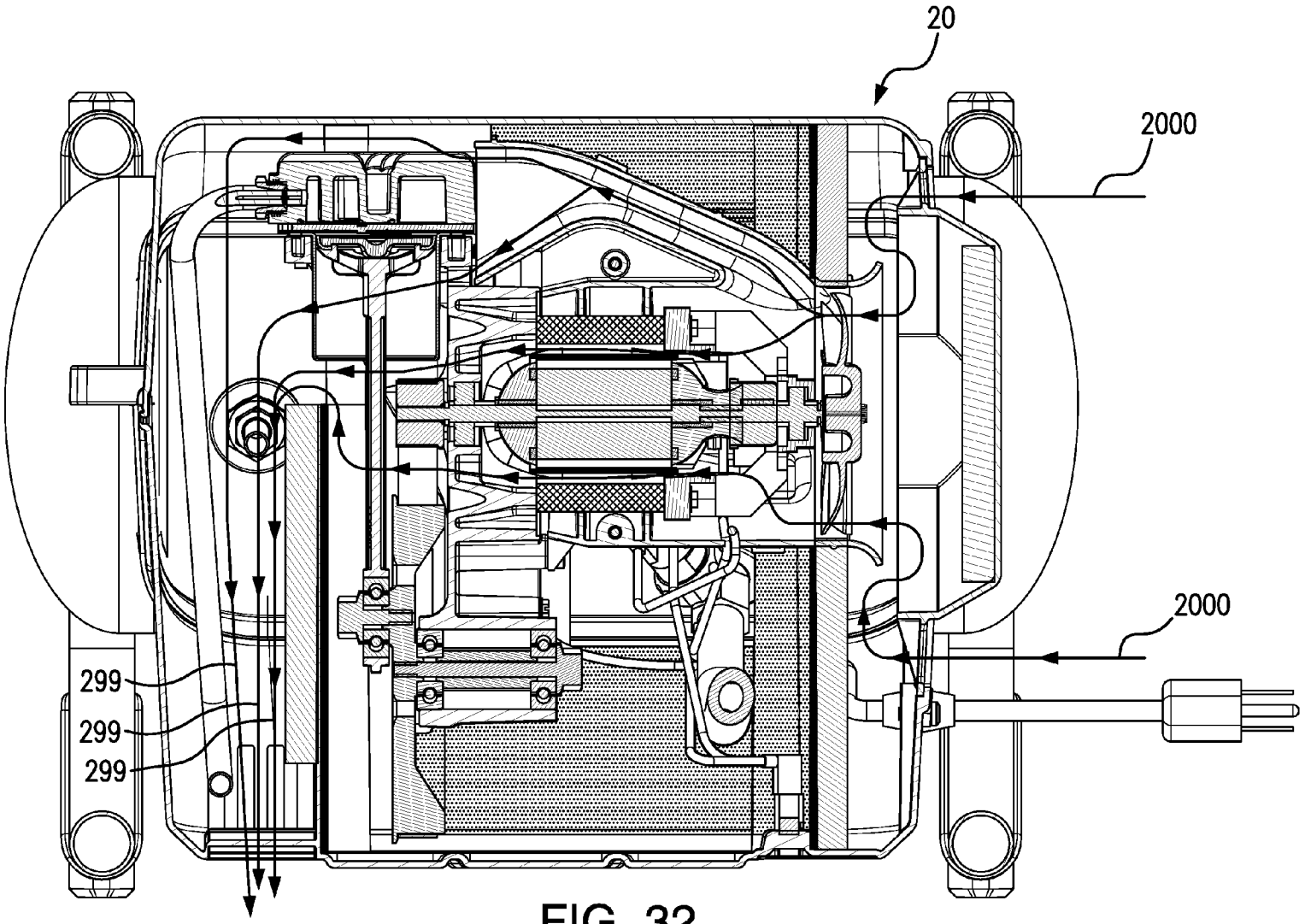
FIG. 32 is a top sectional view showing examples of cooling air plow paths.

FIG. 32 is a top sectional view showing examples of cooling air plow paths.

Cooling air can pass on the two sides of the motor with the field coils. Openings can be used to force air across the windings. Air flow can be blocked on the two sides of the motor having no field coils along those two sides. Cooling air from fan can flow across head and cylinder area.

The scope of this disclosure is to be broadly construed. It is intended that this disclosure disclose equivalents, means, systems and methods to achieve the devices, designs, operations, control systems, controls, activities, mechanical actions, fluid dynamics and results disclosed herein. For each mechanical element or mechanism disclosed, it is intended that this disclosure also encompasses within the scope of its disclosure and teaches equivalents, means, systems and methods for practicing the many aspects, mechanisms and devices disclosed herein. Additionally, this disclosure regards a compressor and its many aspects, features and elements. Such an apparatus can be dynamic in its use and operation. This disclosure is intended to encompass the equivalents, means, systems and methods of the use of the compressor assembly and its many aspects consistent with the description and spirit of the apparatus, means, methods, functions and operations disclosed herein. The claims of this application are likewise to be broadly construed.

The description of the inventions herein in their many embodiments is merely exemplary in nature and, thus, variations that do not depart from the gist of the invention are intended to be within the scope of the invention and the disclosure herein. Such variations are not to be regarded as a departure from the spirit and scope of the invention.

It will be appreciated that various modifications and changes can be made to the above described embodiments of a compressor assembly as disclosed herein without departing from the spirit and the scope of the following claims.

We claim:

1. A compressor assembly, comprising:

a fan;

a pump assembly including a motor having a plurality of motor surfaces, a motor shaft having a longitudinal axis, and a motor speed of 5,000 rpm or greater;

an air ducting shroud which directs cooling air to at least a portion of the motor and which is adapted to dampen a noise from the pump assembly, the air ducting shroud having:

a front inside surface and a rear inside surface;

a front blocking partition integrally molded with the front inside surface and in contact with a front motor surface that is parallel to the longitudinal axis of the motor; and a rear blocking partition integrally molded with the rear inside surface and in contact with a rear motor surface that is parallel to the longitudinal axis of the motor, the rear motor surface being on a laterally opposing side from the front motor surface, wherein the blocking partitions block the formation of an airflow between the motor and the front and rear inside surfaces and force the air that is flowing over an outer surface of the motor to only flow along the outer surfaces that are perpendicular to the front and rear motor surfaces; and a sound level having a value of 75 dBA or less when the compressor is in a compressing state.

2. The compressor assembly according to claim 1, wherein the air ducting shroud encases at least a portion of the fan.

3. The compressor assembly according to claim 1, wherein the air ducting shroud encases at least a portion of the motor.

4. The compressor assembly according to claim 1, wherein the air ducting shroud comprises a conduit which directs a cooling air flow to a cylinder head of the pump assembly.

5. The compressor assembly according to claim 1, wherein the air ducting shroud directs a cooling air flow to at least a portion of a pump of the pump assembly.

6. The compressor assembly according to claim 1, wherein the air ducting shroud directs cooling air to at least a portion of a cylinder of the pump assembly.

7. The compressor assembly according to claim 1, wherein the air ducting shroud further comprises a conduit adapted to direct a cooling air flow to a cylinder head of the pump assembly.

8. The compressor assembly according to claim 1, wherein the air ducting shroud has at least one partition which directs a cooling air flow.

9. The compressor assembly according to claim 1, wherein the air ducting shroud encases the motor and directs a first cooling air flow to a first stator coil of the motor and which directs a second cooling air flow to a second stator of the motor and a third cooling air flow to a cylinder head of the pump assembly.

10. The compressor assembly according to claim 1, further comprising a heat transfer rate from the pump assembly having a value of 60 BTU/min or greater when the compressor is in a compressing state.

11. The compressor assembly according to claim 1, further comprising a cooling air flow rate having a value of 50 CFM or greater when the compressor is in a compressing state.

12. The compressor assembly according to claim 1, wherein the motor has a motor efficiency greater than 45 percent.

13. The compressor assembly according to claim 1, wherein the front blocking partition and the rear blocking partition contact front and rear surfaces of the motor.

14. The compressor assembly according to claim 1, wherein the front blocking partition and the rear blocking partition are integrally formed with the outer perimeter of the air ducting shroud.

15. A method of cooling a compressor assembly, comprising the steps of:

providing a fan;

providing a pump assembly including a motor having a plurality of motor surfaces, a motor shaft having a longitudinal axis and a motor speed of 5,000 rpm or greater;

providing an air ducting shroud which directs a cooling air flow, the air ducting shroud having:

a front inside surface and a rear inside surface;

a front blocking partition integrally molded with the front inside surface and in contact with a front motor surface that is parallel to the longitudinal axis of the motor; and a rear blocking partition integrally molded with the rear inside surface and in contact with a rear motor surface that is parallel to the longitudinal axis of the motor, the rear motor surface being on a laterally opposing side from the front motor surface, wherein the blocking partitions block the formation of an airflow between the motor and the front and rear inside surfaces of the air ducting shroud and force the air that is flowing over an outer surface of the motor to only flow along the outer surfaces of the motor that are perpendicular to the front and rear motor surfaces;

cooling the pump assembly with at least a portion of the cooling air flow provided by the fan when the compressor is in a compressing state; and operating the compressor at a sound level of less than 75 dBA.

16. The method of cooling a compressor assembly according to claim 15, further comprising the steps of:

providing a cylinder head of the pump assembly;

providing a cooling air flow to cool both the motor and the cylinder head; and orienting the motor such that a portion of the cylinder head can receive at least a portion of cooling air which has not cooled the motor.

17. The method of cooling a compressor assembly according to claim 16, wherein the step of providing an air ducting shroud comprises providing an air ducting shroud having a plurality of conduits, and feeding a cooling air through the plurality of conduits to cool the motor.

* * * * *